US007885587B2

(12) United States Patent
Matsuda et al.

(10) Patent No.: US 7,885,587 B2
(45) Date of Patent: Feb. 8, 2011

(54) IMAGE FORMING APPARATUS WITH COLOR SHIFT CORRECTION SUPPRESSING PERIODIC FLUCTUATIONS OF A SURFACE MOVING SPEED OF A LATENT IMAGE SUPPORT

(75) Inventors: Hiromichi Matsuda, Kanagawa (JP); Toshiyuki Andoh, Kanagawa (JP); Yasuhisa Ehara, Kanagawa (JP); Kazuhiko Kobayashi, Tokyo (JP); Noriaki Funamoto, Tokyo (JP); Seiichi Handa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 91 days.

(21) Appl. No.: 12/382,352

(22) Filed: Mar. 13, 2009

(65) Prior Publication Data

US 2009/0238588 A1 Sep. 24, 2009

(30) Foreign Application Priority Data

Mar. 18, 2008 (JP) ..... 2008-068799

(51) Int. Cl.
*G03G 15/00* (2006.01)
*G03G 15/01* (2006.01)

(52) U.S. Cl. ..... 399/301; 399/49

(58) Field of Classification Search ..... 399/301, 399/394, 395, 396, 159, 49, 167; 347/116
See application file for complete search history.

(56) References Cited

U.S. PATENT DOCUMENTS 6,949,896 B2 9/2005 Andoh et al. ..... 318/135
7,327,972 B2 2/2008 Matsuda et al. ..... 399/162
2005/0047834 A1* 3/2005 Tomita et al. ..... 399/301
2006/0275056 A1 12/2006 Matsuda et al. ..... 399/301
2007/0172257 A1 7/2007 Matsuda et al. ..... 399/167
2008/0013972 A1 1/2008 Matsuda ..... 399/45
2008/0170884 A1 7/2008 Matsuda ..... 399/167
2008/0213000 A1* 9/2008 Funamoto et al. ..... 399/167
2008/0226361 A1* 9/2008 Tomita et al. ..... 399/301
2009/0026689 A1 1/2009 Noguchi et al. ..... 271/8.1
2010/0017019 A1 1/2010 Andoh et al. ..... 722/229

FOREIGN PATENT DOCUMENTS

JP 10-078734 3/1998
JP 2005-312262 11/2005

* cited by examiner

*Primary Examiner*—Sophia S Chen
(74) *Attorney, Agent, or Firm*—Harness, Dickey & Pierce, P.L.C.

(57) ABSTRACT

An image forming apparatus includes a control unit to control a latent image support with a target rate; a first unit to detect patterns; plural parts to be detected revolving with the support; a second unit to detect passing of the part; a first generating unit to obtain an amplitude and a phase of fluctuation and a pattern for canceling out the fluctuation from the amplitude and the phase; a second generating unit to perform a process to obtain an amplitude and a phase of fluctuation while the support rotates once or more, perform the process again, calculate a change in the amplitude and phase, and generate another pattern for canceling out the change; and a correcting unit to correct the target rate by superimposing the patterns with the target rate.

14 Claims, 14 Drawing Sheets

IMAGE FORMING APPARATUS WITH COLOR SHIFT CORRECTION SUPPRESSING PERIODIC FLUCTUATIONS OF A SURFACE MOVING SPEED OF A LATENT IMAGE SUPPORT

BACKGROUND OF THE INVENTION

1. Field of the Invention

The present invention generally relates to an image forming apparatus such as a multifunction peripheral, a printer, and a facsimile apparatus.

2. Description of the Related Art

In this type of image forming apparatus, a latent image is formed on a surface of a latent image support having a moving surface, a toner is applied onto the latent image to obtain a toner image, and the toner image is transferred onto a recording member supported on a surface of a surface moving member, or the obtained toner image is transferred onto the surface of the surface moving member and then the toner image on the surface moving member is transferred onto a recording member. Such image forming apparatuses are known to obtain color images by overlapping monochrome images in plural different colors with each other. Such color image forming apparatuses are demanded to perform operations with higher image quality and higher speed. For example, tandem type image forming apparatuses employing a direct transfer method, which forms a color image on a recording member by transferring monochrome images of black (K), yellow (Y), magenta (M), and cyan (C) formed on respective photosensitive body drums (latent image supports) so as to overlap each other onto the recording member supported and transferred by a recording member transfer belt (surface moving member), are known as color image forming apparatuses that can achieve these demands.

In the tandem type image forming apparatuses employing the direct transfer method, a color shift visible to a user may be generated, when transfer positions of the monochrome images are relatively misaligned on the recording member. When such a color shift is generated, for example, image quality is degraded in a such manner that a thin line image, which is formed by overlapping plural monochrome images with each other, is blotted, or a periphery of an outline of a black text image, which is formed in a background image formed by overlapping plural monochrome images with each other, is not colored. Moreover, what is called a banding phenomenon, which is a color density variation periodically generated in a band form, is generated in a colored background area.

Further, there are also known tandem type image forming apparatuses employing an intermediate transfer method, which forms a color image on a recording member by transferring monochrome images of black (K), yellow (Y), magenta (M), and cyan (C) formed on respective photosensitive body drums (latent image supports) so as to overlap each other on an intermediate transfer belt (surface moving member), and then transferring the color image formed on the intermediate transfer belt onto the recording member. In such a tandem type image forming apparatus employing the intermediate transfer method as well, in a similar manner to the tandem type image forming apparatuses employing a direct transfer method, a color shift visible to a user may be generated, when transfer positions of the monochrome images on the intermediate transfer belt are relatively misaligned.

The color shift visible to a user as described above is caused mainly because surface moving speeds of the respective photosensitive body drums periodically change, causing the transfer positions of the monochrome images on the photosensitive body drums to be relatively misaligned. The periodic changes of the surface moving speeds of the photosensitive body drums become notable when rotational angular speeds of rotational driving forces transmitted to the photosensitive body drums change. The changes of the rotational angular speeds are a transmission error (due to eccentricity of a gear, a cumulative pitch error, and the like) of driving transmission systems provided about shafts of the photosensitive body drums, a transmission error (due to a shaft inclination or a shaft misalignment) caused by a coupling provided so that the photosensitive body drums can be detached from the driving transmission systems, and the like.

An image forming apparatus disclosed in Patent Document 1 is known to suppress such a periodic change in the surface moving speed of the photosensitive body drums to correct a color shift. This image forming apparatus detects the periodic change in the surface moving speed of the photosensitive body drums and finely controls the respective rotational angular speeds of the photosensitive body drums to suppress the periodic changes in the surface moving speeds of the photosensitive body drums. Specifically, plural detection patterns (toner images) formed on the respective photosensitive body drums are transferred sequentially (in the order of K, Y, C, and M) to be aligned in a line onto an intermediate transfer belt. These detection patterns are sequentially detected by a first detection unit. In response to a detection signal of the first detection unit, a periodic change component of the surface moving speeds (detected data) of the photosensitive body drums is detected. The respective rotational angular speeds of the photosensitive body drums are finely controlled so as to cancel out the periodic changes of the surface moving speeds.

Another image forming apparatus capable of correcting such a color shift is disclosed in Patent Document 2. This image forming apparatus has, about the rotation shafts of the photosensitive body drums, plural projecting parts to be detected, which are arranged annularly, and revolve and move in accordance with the rotation of the respective photosensitive body drums. The respective photosensitive body drums have detectors (detecting units) for detecting the passing by of the parts to be detected. The detector detects the parts to be detected which pass through a detection area in accordance with the rotation of the photosensitive body drum, detects a periodic change component of the rotation speed of the photosensitive body drum, which has the same periodicity as one rotation period of the photosensitive body drum, and finely control the respective rotational angular speeds of the photosensitive body drums so as to cancel out the periodic rotation changes.

[Patent Document 1] Japanese Patent Application Publication No. 10-78734

[Patent Document 2] Japanese Patent Application Publication No. 2005-312262

However, the method to finely control the photosensitive body drum, disclosed in Patent Document 1, requires a control step of forming plural detection patterns, detecting these detection patterns, and calculating a control value (correction value) based on the detection signals. This control step is normally performed only once after the photosensitive body drum is assembled in the image forming apparatus. However, a driving transmission part such as a gear and a shaft bearing is deformed by abrasion, or a housing supporting the driving transmission part is deformed by a temperature change, a change of a setting location of the image forming apparatus, and the like, while operating in the market. Thus, the surface moving speeds and the rotation speeds (referred to "speed change" hereinafter), having the same period with one rotation period of the photosensitive body drum, change. When a gear of the photosensitive body drum shaft is inclined due to the abrasion of the shaft bearing and the deformation of the housing, in particular, a speed change of one rotation period of the photosensitive body drum is increased. As a result, a color shift is generated.

To suppress such a color shift, the control step is required to be performed after starting operation in the market as well. In this case, however, there is a problem in that toner is consumed to form the detection patterns. Detection patterns for plural number of rotations of the photosensitive body drums are preferably formed to remove a noise component from pattern detection data and detect a speed fluctuation which changes due to the environment or over time. In this case, therefore, toner consumption is increased.

By the method disclosed in Patent Document 2, by which driving of the photosensitive body drums is finely controlled, there is a problem in precision when positioning the plural parts to be detected. An error of setting the positions of the parts to be detected leads to an error in detecting a speed fluctuation having the same period as one rotation period of the photosensitive body drum. Further, when providing a member formed of plural parts to be detected, which are annularly integrated, to a photosensitive body drum shaft, eccentricity caused by an error in the assembly also leads to an error in detecting a speed fluctuation having the same period as one rotation period of the photosensitive body drum. Such an error in detection not only cannot suppress a color shift, but it may actually increase a color shift. Since there is such a problem of the precision in positioning of the parts to be detected, it has been difficult to use a low cost part to be detected having a relatively dissatisfactory precision of setting position, such as one formed inexpensively by plastic molding or the like in a flange part on a side surface of a photosensitive body drum or a flange part on a side surface of a gear. Therefore, it has been required to use an expensive part to be detected, such as one formed with high precision by edging a metal disk member, to solve the problem of the precision in positioning of the part to be detected.

SUMMARY OF THE INVENTION

The present invention is made in light of the above circumstances and it is an object of at least one embodiment of the present invention to provide an image forming apparatus which can suppress, with high precision, a periodic fluctuation of a surface moving speed of a latent image support, which is caused by a rotational angular speed fluctuation of a rotational driving force transmitted to the latent image support, and, even when there is a change in the fluctuation of the surface moving speed after the above suppression, can also reduce the changed fluctuation of the surface moving speed without consuming additional toner.

According to one aspect of the present invention, an image forming apparatus for forming an image on a recording member by forming a latent image on a surface of a rotating latent image support and transferring a toner image, which is obtained by applying a toner on the latent image, onto the recording member supported onto a surface of a surface moving member, or transferring the toner image onto the surface of the surface moving member and then transferring the toner image onto the recording member, is provided. The above-described image forming apparatus includes a driving control unit to drive and control the latent image support so that the latent image support rotates at a target rate; a first detecting unit to detect plural detection patterns, which are formed by forming latent images on the surface of the latent image support, develop the latent images, and transfer the developed latent images on the surface of the surface moving member, and are arranged along a surface moving direction of the surface moving member; plural parts to be detected, which revolve in accordance with the rotation of the latent image support; a second detecting unit to detect a passing by of one of the parts to be detected at a specific point on a movement path of the parts to be detected; a first correcting pattern generating unit to obtain an amplitude and a phase of a fluctuation component of an interval between the detection patterns, which indicates a periodic fluctuation of a surface moving speed of the latent image support, from pattern detection data obtained by detecting the plural detection patterns by the first detecting unit, and generate a first rate correcting pattern for canceling out the periodic fluctuation of the surface moving speed based on the amplitude and the phase; a second correcting pattern generating unit to perform an obtaining process to obtain a first amplitude and a first phase of a fluctuation component of an interval between the parts to be detected, which indicates a periodic fluctuation of the surface moving speed of the latent image support, from parts detection data obtained by detecting the plural parts to be detected by the second detecting unit in a predetermined time in which the latent image support rotates once or more, perform the obtaining process again at a predetermined timing to obtain a second amplitude and a second phase, calculate a change amount of the second amplitude and the second phase with respect to the first amplitude and the first phase, and generate a second rate correcting pattern for canceling out the change amount; and a correcting unit to correct the target rate by superimposing the first rate correcting pattern and the second rate correcting pattern with the target rate.

DETAILED DESCRIPTION OF THE PREFERRED EMBODIMENTS

An embodiment in which the present invention is applied to a tandem type image forming apparatus of an intermediate transfer type, a toner pattern detecting method, and a correcting method thereof are described below.

The image forming apparatus of this embodiment performs a first correcting process to correct a control value for controlling a photosensitive body driving motor according to a detection result of plural detection patterns, which are formed of toner images in a ladder form, and also performs a second correcting process to correct a control value for controlling a photosensitive body driving motor according to a detection result of detecting marks or slits to be detected, which correspond to plural parts to be detected and rotate and move in accordance with a rotation of the photosensitive body drum (latent image support).

A basic configuration and a basic operation of an image forming apparatus, to which the present invention is applied, are described below. Then, the first and second correcting processes are described in this order. At last, an operation process using these two correcting processes is described.

[Overall Description]

Figure 1:
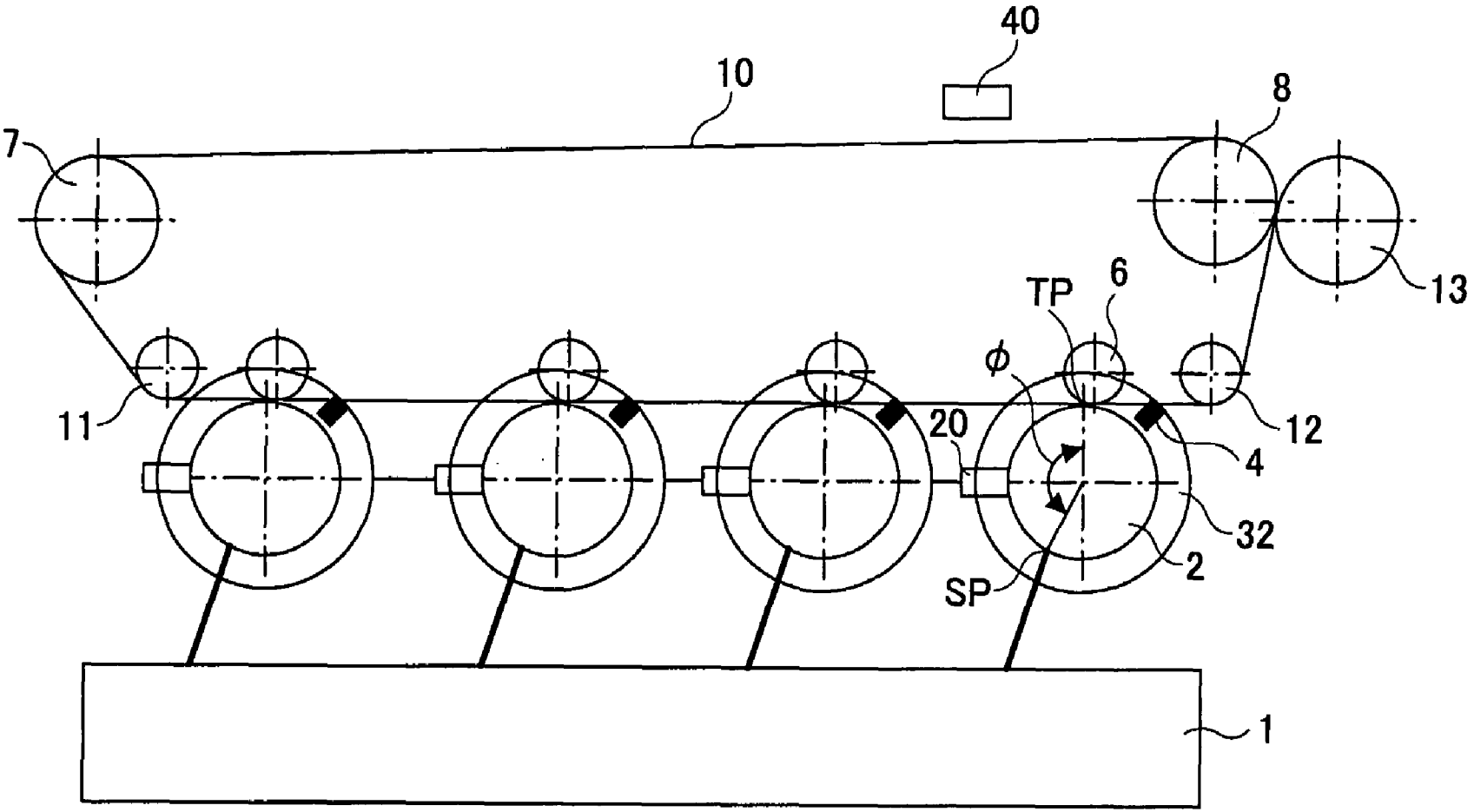
FIG. 1 is a schematic configuration diagram showing a major configuration of an image forming apparatus to which the present invention is applied.

FIG. 1 is a schematic configuration diagram which shows a major configuration of an image forming apparatus to which the present invention is applied. When the image forming apparatus is used as a product such as a multifunction peripheral or a printer, then a paper feed table for holding a large amount of paper, a scanner unit, or an automatic document feeder (ADF) is provided as required in addition to the major configuration shown in FIG. 1.

As shown in FIG. 1, the image forming apparatus of this embodiment includes an intermediate transfer belt 10 formed of an endless belt, serving as an intermediate transfer body as a surface moving member. The intermediate transfer belt 10, being wrapped around support rollers 7, 8, 11, and 12 serving as four support rotation bodies, has a surface moving counterclockwise in FIG. 1. In this embodiment, the support roller 8 serves as a driving roller among the four support rollers. Moreover, an intermediate transfer belt cleaning device, for removing a toner remaining on the intermediate transfer belt 10 after an image transfer, is provided on a left side of the support roller 7 in FIG. 1, although not shown. Moreover, in a part of the belt, extending between the support rollers 11 and 12, four image forming units of yellow (Y), cyan (C), magenta (M), and black (K) are arranged in a row along the moving direction of the surface of the belt. A photosensitive body drum 2 serving as a latent image support which rotates clockwise in FIG. 1, a drum driving gear 32, and a bias roller 6 are provided in the respective image forming units. Further, the respective image forming units have a charging device, a developing device, and a cleaning device, which are not shown, around the photosensitive body drums 2. These image forming units have the same configurations except that the colors of toners to be used are different.

The bias roller 6 is arranged facing the photosensitive body drum 2 with the intermediate transfer belt 10 interposed therebetween. The bias roller 6 causes the intermediate transfer belt 10 to contact the respective photosensitive body drums 2. A marking 4 is provided on the respective drum driving gears 32. These markings 4 are detected by respective drum position sensors 20. Rotation positions of the photosensitive body drums 2 can be detected according to detection results of the respective drum position sensors 20.

Further, a pattern sensor 40 serving as a first detecting unit, for detecting a detection pattern formed on the intermediate transfer belt 10, is provided facing the surface of the intermediate transfer belt 10. In this embodiment, two pattern sensors 40 are arranged in a row in a direction (referred to a "belt width direction", hereinafter) vertically crossing a direction that the surface of the intermediate transfer belt 10 moves. Note that the number of the pattern sensors 40 is not limited. By increasing the number of the pattern sensors 40, the precision of detection data can be improved, detecting operation can be performed in a shorter time, and a fluctuation in a main scanning direction can be detected.

When the pattern sensors are increased to four, for example, measurement precision can be improved since a similar detection pattern in the same color is detected by the four pattern sensors. Further, by detecting the detection patterns in the four colors by using respective pattern sensors, the patterns in the four colors can be measured by one operation, which can reduce the time required for detection. Moreover, a misalignment in the main scanning direction can be simultaneously detected from the data of the four positions aligned in the belt width direction.

Moreover, an exposure apparatus 1 serving as a latent image forming unit is provided below the four image forming units in the image forming apparatus.

A secondary transfer roller 13 serving as a second transfer unit is provided facing the driving roller 8 with the intermediate transfer belt 10 interposed therebetween. The secondary transfer roller 13 is provided in a pressed manner onto the intermediate transfer belt 10 toward the driving roller 8. A sheet as a recording member is transferred at a predetermined timing from a lower side in the drawing to a nip part (secondary transfer part) formed between the secondary transfer roller 13 and the intermediate transfer belt 10. An image on the intermediate transfer belt 10 is transferred onto the sheet by the secondary transfer roller 13. Note that a transfer belt or a non-contact type charger may be used as the second transfer unit.

In the image forming apparatus, a fixing device, which is not shown, is provided on an upper side of the secondary transfer roller in the drawing. This fixing device performs a fixing process for fixing the image transferred on the sheet.

An image forming operation of the image forming apparatus is described.

When the image forming apparatus is used as a multifunction peripheral, a document is set on a document stage of a document automatic transfer device, which is not shown, or the document automatic transfer device is opened, the document is set on a contact glass of a scanner unit, and the document automatic transfer device is closed to press the document. Then, a start switch not shown in the drawing is pressed, thereby the document set on the document stage of the document automatic transfer device is transferred onto the contact glass and then a scanning unit of the scanner unit starts driving.

When the document is set on the contact glass, the scanning unit of the scanner unit starts driving when the start switch is pressed. As a scanning unit runs, light from a light source is emitted onto a surface of the document. A reflected light of the light source is received by a reading sensor through an imaging lens, thereby a content of the document is read. Then, a following image forming process is performed according to image data based on the read content of the document.

When the image forming apparatus is used as a printer, image data is received from an external apparatus such as a personal computer or a digital camera. By using the received image data, a following image forming process is performed.

In parallel with a reading process of a document or a receiving process of image data as described above, the driving roller 8 is rotated by a driving motor serving as a driving source which is not shown. Accordingly, the surface of the intermediate transfer belt 10 is moved counterclockwise in the drawing, and in accordance with this movement, other support rollers (follower rollers) rotate. At the same time, the photosensitive body drums 2 in the respective image forming units are rotated. Exposure is performed onto the respective photosensitive body drums 2 using color data of yellow, cyan, magenta, and black, and development thereof is performed by the respective developing devices to obtain monochrome toner images. Then, the monochrome toner images formed on the photosensitive body drums 2 are sequentially transferred to overlap each other onto the intermediate transfer belt 10, to form a synthetic color image on the intermediate transfer belt 10.

In parallel with this image forming process, a sheet is transferred to the secondary transfer unit at a predetermined timing. Specifically, a sheet is fed from a paper feed cassette, separated by a separation roller one by one to be sent to a paper feed path, and transferred by a transfer roller to reach and stop at a resist roller. Alternatively, a sheet on a manual feed tray is fed by the paper feed roller rotating, separated by the separation roller one by one to be sent to a manual paper feed path, and also transferred to reach and stop at the resist roller. The resist roller is rotated at a timing the synthetic color image on the intermediate transfer belt 10 reaches the secondary transfer unit, to send the sheet to the secondary transfer unit. Although the resist roller is generally grounded when used, a bias voltage may be applied to the resist roller for removing paper dust of the sheet. The synthetic color image formed on the intermediate transfer belt 10 is transferred onto a sheet by an effect of a secondary transfer bias applied to the secondary transfer roller 13. The sheet having the image transferred thereon is sent to the fixing device, where heat and pressure are applied to fix the transferred image on the sheet. The sheet having the image fixed is outputted by an output roller, which is not shown, to be stacked onto a paper output tray.

By using the image forming apparatus, a monochrome image can be formed as well. For example, when a black monochrome image is formed, the intermediate transfer belt 10 is preferably separated from the photosensitive body drums 2 of the three colors, yellow, cyan, and magenta, by a contacting/separating unit which is not shown, so that these photosensitive body drums 2 of the three colors temporarily stop driving.

Drum driving devices of the respective photosensitive body drums 2 are described.

Figure 2:
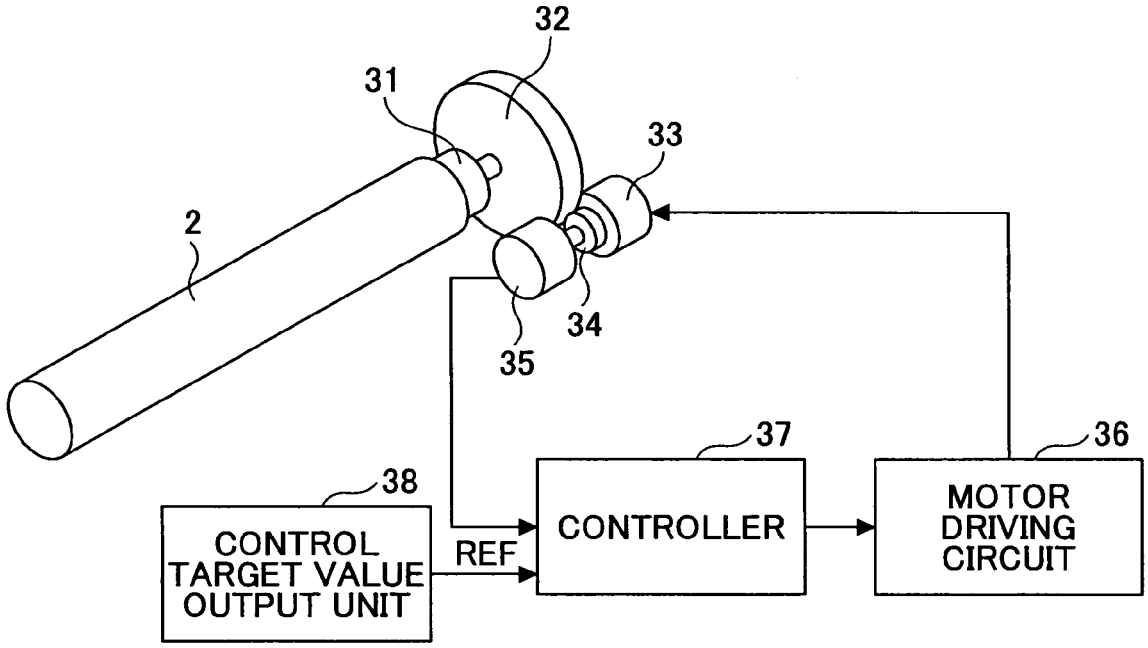
FIG. 2 is a diagram showing an example of a drum driving device for driving a photosensitive body drum of the image forming apparatus.

FIG. 2 is a diagram showing an example of a drum driving device which drives the photosensitive body drum 2. Note that the drum driving devices of the photosensitive body drums of yellow, cyan, magenta, and black have similar configurations.

In this embodiment, a rotation shaft (drum shaft) of the photosensitive body drum 2 is rotatably supported by a frame of a body of the image forming apparatus, which is not shown. The drum driving device of this embodiment is formed of a driving motor 33, which is formed of a stepping motor, a DC servomotor, or the like, a motor shaft gear 34 provided for a motor shaft of the driving motor 33, a drum driving gear 32 fixed on a driving shaft and engaging the motor shaft gear 34, and a coupling 31 connecting the driving shaft and the drum shaft.

In this embodiment, a single speed reduction mechanism formed of the motor shaft gear 34 and the drum driving gear 32 is used, to reduce cost by reducing components and reduce a factor of a gear error caused in gear transmission and a transmission error caused by eccentricity. Further, by using such a single speed reduction mechanism, when a high reduction ratio is set, the drum driving gear 32 on the drum shaft of the photosensitive body drum 2 necessarily becomes a gear with a diameter larger than the photosensitive body drum 2. By using the gear with the large diameter as the drum driving gear 32, a single pitch error of the drum driving gear 32 converted on the photosensitive body drum 2 becomes smaller, and there is less effect of a printing density variation (banding) in a vertical scanning direction. Note that the reduction ratio is determined depending on a speed area, where a high efficiency and a high rotation precision of a target rotation speed and a motor characteristic of the photosensitive body drum 2 are achieved. A reduction ratio between the motor shaft gear 34 and the drum driving gear 32 in this embodiment is 1:20.

A motor shaft of the driving motor 33 is connected to a rotary encoder 35. The rotary encoder 35 detects a rotation state of the driving motor 33, and feeds back the detection signal through a controller 37 to a motor driving circuit 36 of the driving motor 33, to control a rotation speed of the driving motor 33 to be a desired speed. Note that when the driving motor 33 incorporates a speed sensor or an encoder, the rotary encoder 35 can be omitted. As a speed sensor incorporated in the motor, for example, a print coil type frequency electric generator (FG) can be used. As an incorporated encoder, for example, an MR sensor can be used.

The motor driving circuit 36 outputs a predetermined driving current to the driving motor 33. The rotary encoder 35 detects a rotational angular speed (or a rotational angular displacement) of the motor 33 and outputs a detection result to the controller 37. A DC servomotor of a DC brushless motor is employed as the driving motor 33 in this embodiment. The DC servomotor includes a coil and a rotor, which are connected by a star-delta connection of U, V, and W. Further, three hole elements for detecting a magnetic pole of the rotor are provided as position detecting units of the rotor. Output terminals of the three hole elements are connected to the motor driving circuit 36. When the DC servomotor incorporates an MR sensor, a rotational speed detecting unit (speed data detecting unit) formed of an MR sensor and a magnetic pattern polarized on an outer surface of the rotor, having an output terminal connected to the controller 37, is provided. The motor driving circuit 36 includes three high-side transistors and three low-side transistors, which are connected to U, V, and W of the coil. The motor driving circuit 36 specifies a position of the rotor according to a rotor position signal generated by the hole elements, and generates a phase switching signal. The phase switching signal controls the transistors of the motor driving circuit 36 to be on and off, and rotates the rotor by sequentially switching a phase to be excited.

Further, the controller 37 compares a rotational speed data detected by the rotary encoder 35 (the rotational speed detecting unit when the MR sensor is incorporated), with target rotational speed data, to generate and output a PWM signal so that the rotational speed of the motor shaft, which is detected, becomes the target rotational speed. The PWM signal is logically multiplied with the phase switching signal of the motor driving circuit 36 by an AND gate, performs chopping of a driving current, and controls a rotational speed of the driving motor 33.

The controller 37 can be formed of a known PLL control circuit system, which compares a phase and a frequency of an output pulsed signal of the rotary encoder 35 or the rotational speed detecting unit, with those of an output pulsed signal of a control target value output unit 38. The control target value output unit 38 outputs a pulsed signal, of which frequency is modulated in accordance with a target rotational speed, set in advance, for correcting a rotational speed fluctuation component of one rotation period of the photosensitive body drum. The controller 37 may be formed of an analog circuit or a digital circuit. In a case of digital processing, a period of an output waveform by the rotary encoder 35 or the rotational speed detecting unit is measured to obtain a rotational angular speed. Alternatively, the number of output pulses of the rotary encoder 35 or the rotational speed detecting unit is counted, and the rotational speed is calculated by the count value measured in an arbitrary time. Note that when a rotational angular displacement is controlled instead of a rotational angular speed, by a position control system, the number of output pulses of the rotary encoder 35 or the rotational speed detecting unit is counted to obtain a displacement amount of a rotational angle. By calculating a difference between the calculated value with the target data of the control target value output unit, the driving motor 33 is driven so that the difference becomes smaller. In general, a PID controller and the like are incorporated to control the photosensitive body drum 2, so that a deviation, overshooting, or oscillation is not generated with respect to the target rotational speed, to output a PWM signal to the motor driving circuit 36.

[First Correcting Process]

A first correcting process concerning a rotational driving control of the photosensitive body drums 2 is described.

In this embodiment, a DC servomotor of a DC brushless motor is used as the driving motor 33 driving the respective photosensitive body drum 2. When the photosensitive body drums 2 are driven, fluctuations in the surface moving speed of the photosensitive body drums 2 are individually caused by the following two factors. As a result, when monochrome toner images on the photosensitive body drums 2 are transferred onto the intermediate transfer belt 10 to overlap each other, the transfer positions are relatively misaligned, which leads to a color shift. As a first factor that causes such a color shift, a fluctuation of a motor rotation caused by a torque ripple and the like, which causes a fluctuation of a rotational angular speed transmitted to the photosensitive body drum 2. As a result, a surface moving speed of the photosensitive body drum 2 is fluctuated, and a transfer position of a toner on the photosensitive body drum 2 on the intermediate transfer belt 10 is misaligned from an ideal position in a belt surface moving direction (vertical scanning direction), which is simply referred to as "position misalignment", hereinafter. A second factor is a cumulative pitch error of a gear (including the drum driving gear 32) of the drum driving device, eccentricity of the rotation shaft of the drum driving gear 32, and the like, which cause a fluctuation of the rotational angular speed transmitted to the photosensitive body drum 2. As a result, the surface moving speeds of the respective photosensitive body drums 2 are fluctuated, leading to a position misalignment.

The fluctuation of the surface moving speed of the photosensitive body drum 2 according to the first factor can be sufficiently suppressed by the aforementioned feedback control using the detection result of the rotary encoder, which is attached to the motor shaft. The fluctuation of the surface moving speed of the photosensitive body drum 2 according to the second factor is suppressed by obtaining, based on the detection result of the detection patterns, an amplitude and a phase of a fluctuation component of the surface moving speed generated in one rotation period of the photosensitive body drum 2. According to the obtained data, the rotational angular speed of the driving motor 33 is controlled to suppress the fluctuation. The detail of this control is described below.

Next, a detection method of a transfer position control pattern is described.

Figure 3:
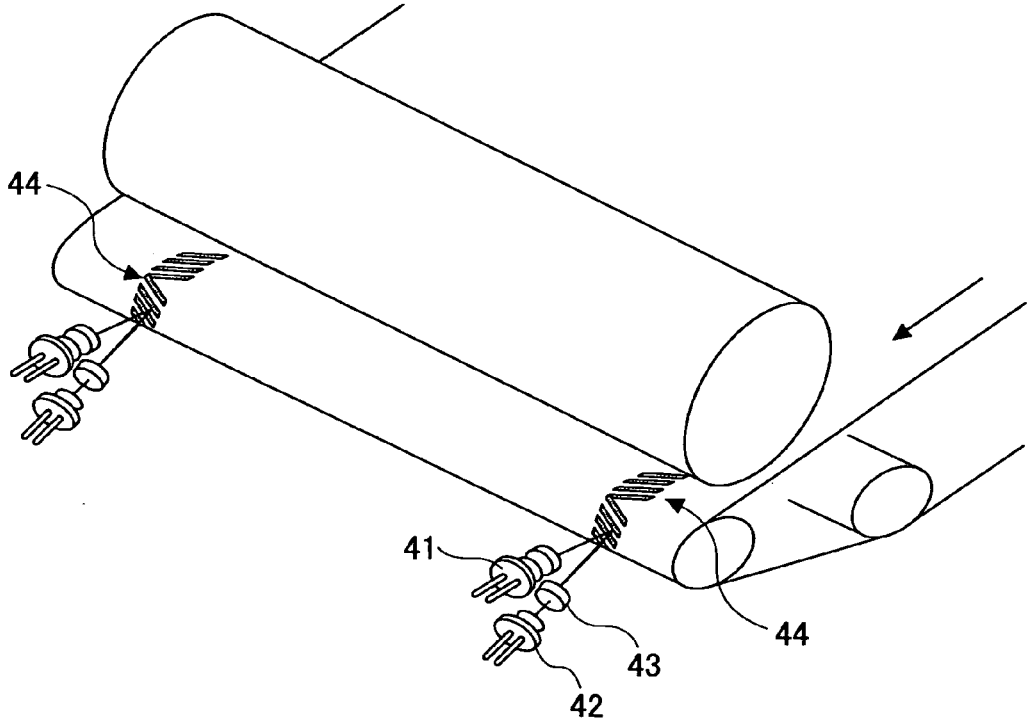
FIG. 3 is a diagram showing a pattern detection mechanism for detecting patterns on an intermediate transfer belt, which are formed by image forming units.

FIG. 3 is a diagram showing a pattern detecting mechanism for detecting transfer position control patterns 44, which are formed by the image forming units, on the intermediate transfer belt 10. In FIG. 3, a pattern sensor 40 is provided at a different position from that shown in FIG. 1 for convenience.

The pattern sensor 40 of this embodiment includes LED elements 41 serving as light sources, which are provided as a pair in opposing end parts in the belt width direction of an image area of the intermediate transfer belt 10, a light receiving element 42 which receives a reflected light, and a pair of light collecting lenses 43. The LED element 41 has a light intensity to generate the reflected light required to detect the transfer position control patterns 44 on the intermediate transfer belt 10. Further, the light receiving element 42 is provided at a position where the light reflected by the transfer position control patterns 44 on the intermediate transfer belt 10 enters through the light collecting lens 43. The light receiving element 42 is formed of a CCD serving as a line type receiving element formed of a number of linearly arranged light receiving pixels.

By providing the pattern sensor 40 at each opposing end part in the belt width direction of the image area of the intermediate transfer belt 10 as described in this embodiment, a resist control in the main scanning direction (a direction vertically crossing the surface moving direction of the photosensitive drum 2 and the intermediate transfer belt 10), a resist control in the vertical scanning direction (the surface moving direction of the photosensitive body drum 2 and the intermediate transfer belt 10), a control of a magnification error in the main scanning direction, a control of an inclination of a scanning line with respect to the main scanning direction, and the like can be performed.

Figure 4:
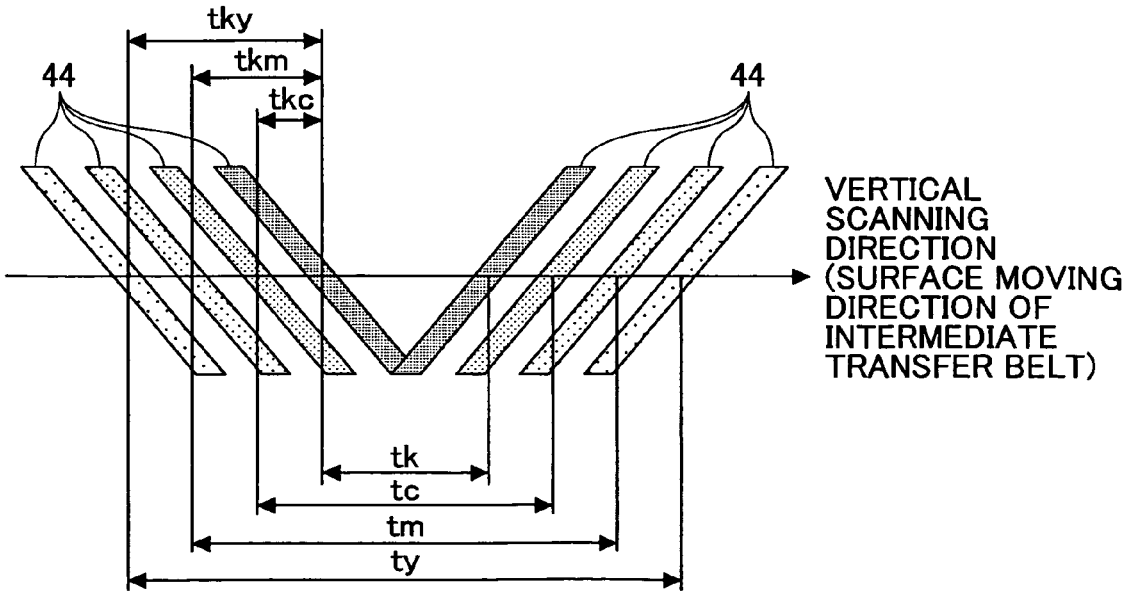
FIG. 4 is a diagram showing an example of a transfer position controlling pattern.

FIG. 4 is a diagram showing an example of the transfer position control patterns 44. As shown in FIG. 4, the transfer position control patterns 44 are formed of line patterns referred to as a chevron patch, formed by arranging toner images of black, cyan, magenta, and yellow to be parallel with each other at a predetermined pitch and be inclined at 45° with respect to the vertical scanning direction. The transfer position control patterns 44 are formed at the opposing end parts in the belt width direction of the image area of the intermediate transfer belt 10. By reading the transfer position control patterns 44 by the pattern sensor 40, a difference in time required for detecting, between black as a reference color and the other three colors, is detected in accordance with the surface movement of the intermediate transfer belt 10. Specifically, line patterns sequentially formed of yellow, magenta, cyan, black, black, cyan, magenta, and yellow in this order from right to left in the drawing are sequentially read by the pattern sensor 40, to obtain time differences (detection time differences) tky, tkm, and tkc between the detection time of black as the reference color and the detection time of the other three colors. According to differences between the obtained detection times and ideal values, amounts of misalignment of vertical scanning resists of respective colors with respect to black are obtained. Further, according to the detection result of the pattern sensor 40, detection time differences tk, tc, tm, and ty between two line patterns of the same color with different inclination angles are obtained. According to differences between the detection time differences and ideal values, misalignments of the main scanning resist of the respective colors are obtained.

An inclination of a scan line can be obtained according to a vertical scanning resist difference between a pair of detection patterns 45 formed at the opposing end parts of the belt width direction. The inclination of the scanning line is corrected by driving an inclination control unit of a toroidal lens in accordance with the inclination of the scan line obtained in this manner.

In the case of correcting the vertical scanning resist, a misalignment of the vertical scanning resist is obtained based on an average value of the detection values, to adjust write timing in the vertical scanning direction, per one surface of a polygon mirror, that is, by using a unit of one scan line pitch. Alternatively, an average rotational angular speed of the driving motor 33 of the photosensitive body drum 2 is controlled to control time required for the drum to rotate between a write position and a transfer position on the surface of the photosensitive body drum 2.

Figure 5A:
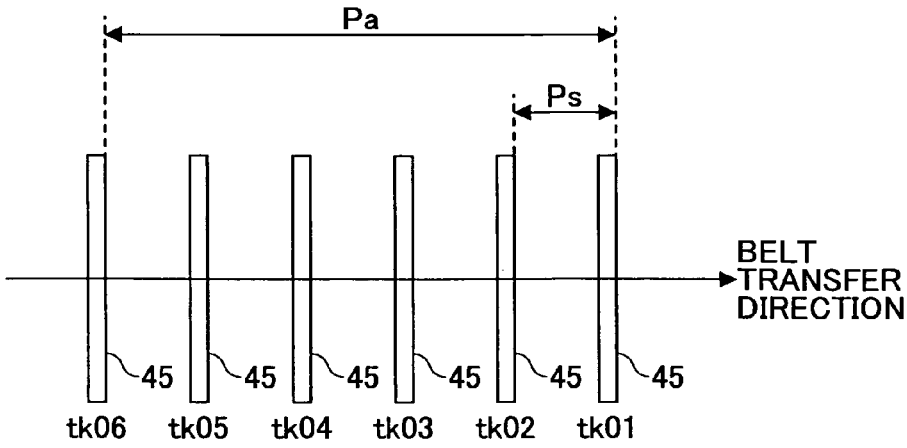
FIGS. 5A and 5B are diagrams showing examples of detection patterns 45 used for suppressing a periodic surface moving speed fluctuation of a photosensitive body drum.
Figure 5B:
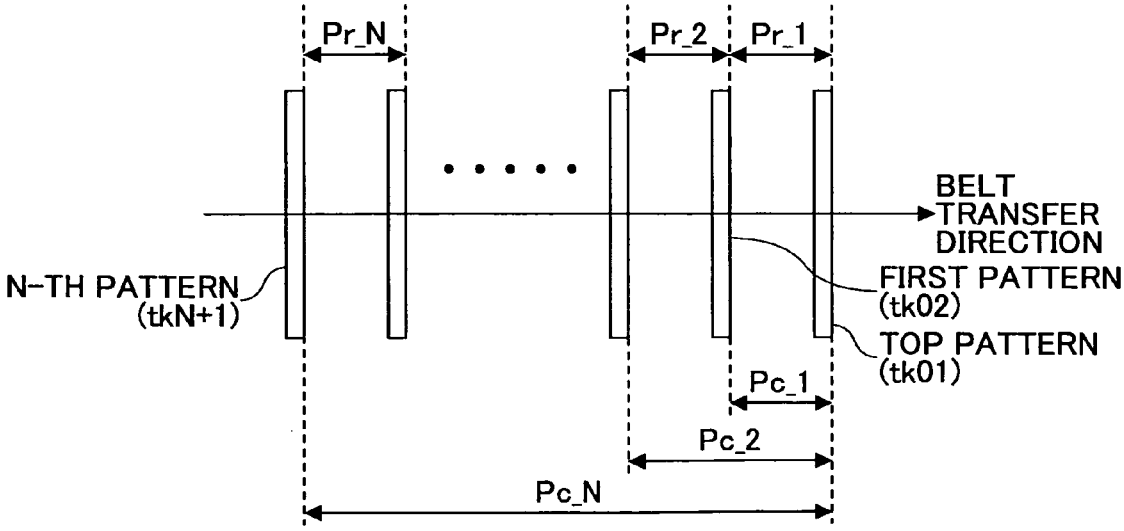

FIGS. 5A and 5B are diagrams showing examples of the detection patterns 45 used to suppress the fluctuation in the surface moving speed of the photosensitive body drum 2 caused by the second factor.

The detection patterns 45 are formed by arranging toner image patterns of one of black, cyan, magenta, and yellow, which are longer in the main scanning direction, to be in parallel with each other at a predetermined pitch along the vertical scanning direction. Each of these detection patterns 45 is sequentially detected by the pattern sensor 40 in an order in which these patterns are formed, to obtain detection times tk01, tk02, tk03, . . . from an arbitrary reference timing. This process is performed for each color. In this embodiment, by forming detection patterns of two different colors in the opposing end parts of the belt width direction of the intermediate transfer belt 10, the detection of the two colors can be simultaneously performed by the pattern sensor 40. That is, by repeating the detection operation twice, detection of all of the four colors can be completed in this embodiment. As a result, the detection time can be reduced. Further, since the detection patterns 45 are formed of monochrome patterns in this embodiment, pattern pitches can be extremely shortened. Consequently, detection can be performed with higher precision.

Figure 6:
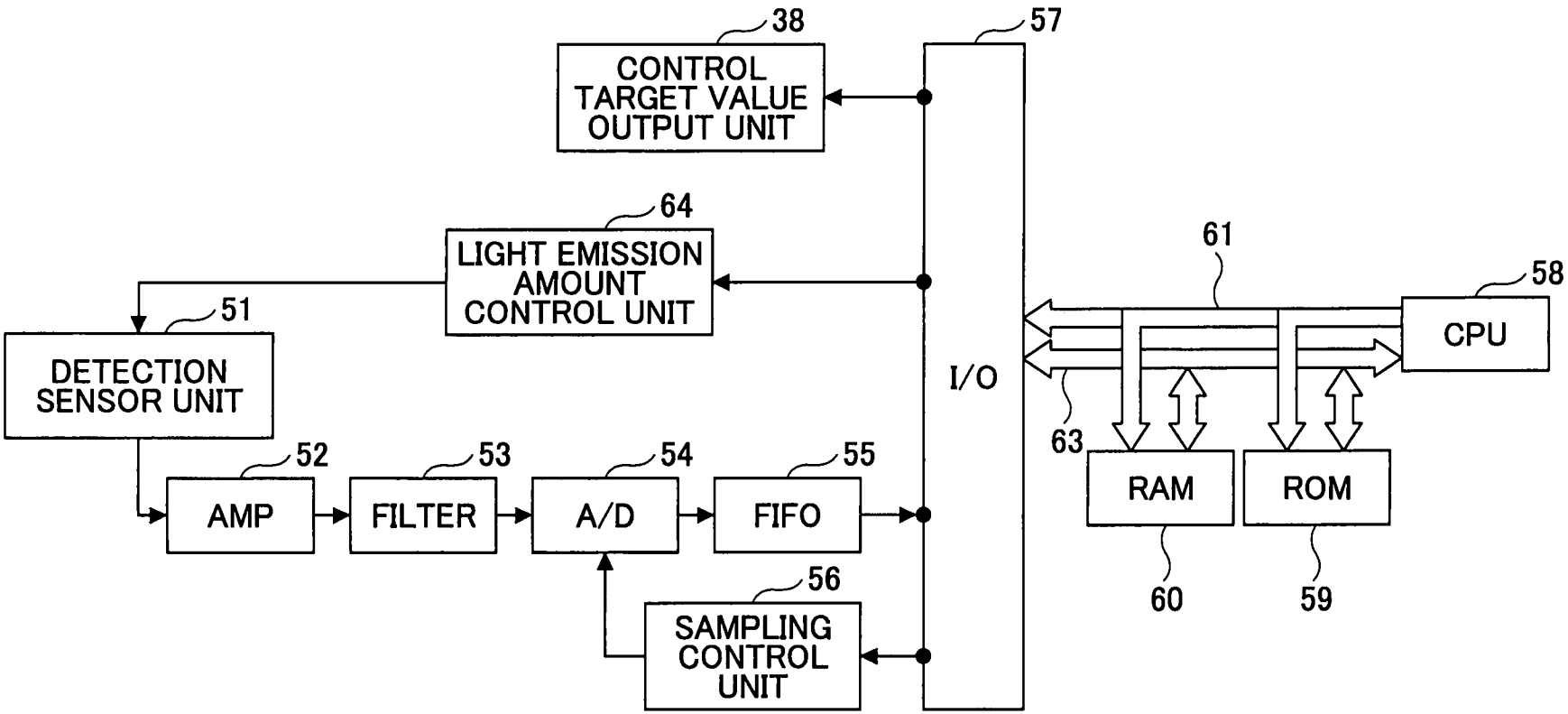
FIG. 6 is a block diagram showing an electric hardware configuration of a drum driving device.

FIG. 6 is a block diagram showing an electric hardware configuration of a drum driving device. A signal obtained by a detection sensor unit 51 including the pattern sensor 40 shown in FIG. 3 is amplified by an AMP 52 and only a signal component of the transfer position control pattern 44 shown in FIG. 4 and the detection pattern 45 shown in FIGS. 5A and 5B pass through a filter 53. The signal which has passed through the filter 53 is converted from analog data into digital data by an A-D converter 54. Sampling of the data is controlled by a sampling control unit 56. The sampled data are stored in a FIFO memory 55. After the detection of the detection pattern 45 is ended, the stored data are loaded into a CPU 58 and a RAM 60 by a data bus 63 through an I-O port 57, and undergo an operation process in the CPU 58 to calculate various misalignments as described above.

First, according to various correction amounts obtained from the detection signals of the transfer position control patterns 44 shown in FIG. 4, the CPU 58 changes settings for driving and writing control of a stepping motor, which is not shown, serving as a driving source of the intermediate transfer belt 10, in order to perform skew correction, and change the main scanning resist, the vertical scanning resist, and an image frequency based on a magnification error. For the writing control, clock generators and the like, using a device of which output frequency can be very finely set, such as a VCO (Voltage Controlled Oscillator), are provided for the respective colors, in addition to the control of the main scanning resist and the vertical scanning resist. In the image forming apparatus of this embodiment, an output signal of these devices is used as an image clock.

Subsequently, in this embodiment, a driving control value of the driving motor 33 is corrected by the correction value obtained from the detection signal of the detection patterns 45 shown in FIGS. 5A and 5B, so that a position misalignment generated in one rotation period of the photosensitive body drum becomes less. A driving control value after the correction is set in the control target value output unit 38. The control target value output unit 38 outputs a rotational speed target value (digital data or pulsed row signal) to the controller 37 of the respective photosensitive body drums 2.

The CPU 58 monitors the detection signal from the detection sensor unit 51 at an appropriate timing and controls light emission by a light emission amount control unit 64, so that the detection patterns 45 can be accurately detected even when degradation of the intermediate transfer belt 10 and the LED element 41 of the detection sensor unit 51, and the like are caused. Accordingly, a level of a light receiving signal from the light receiving element 42 of the detection sensor unit 51 is controlled to be always constant.

The ROM 59 stores various programs such as a program for operating the various misalignments. Further, an address bus 61 specifies a ROM address, a RAM address, and various input-output devices.

Next, a configuration and an operation for suppressing a fluctuation in the surface moving speed of the photosensitive body drum 2 caused by the second factor, as one of the features of the present invention, are described. In this embodiment, the detection patterns 45 shown in FIG. 45 are used as patterns to suppress a fluctuation in the surface moving speed of the photosensitive body drum 2 caused by the second factor. The detection patterns 45 are formed in plural numbers (for example, corresponding to plural rotations of the photosensitive body drum) continuously along the surface moving direction of the intermediate transfer belt 10. Note that the detection patterns 45 are monochrome patterns so that the patterns can be detected at a high precision and the detection patterns are not degraded by multi-transfer of plural colors of patterns (distortion of a toner image caused by opposite transfer). In the case where the pattern degradation caused by the multi-transfer is not a problem, patterns in four colors of K, Y, M, and C may be alternately formed in parallel with each other along the vertical scanning direction.

Further, as shown in FIG. 5A, a sampling pattern length Pa in the surface moving direction of the intermediate transfer belt 10 is set as an integral multiple of a rotation fluctuation period of the photosensitive body drum 2. The pattern length is required to be set in consideration of other periodic rotation fluctuation generated when forming and detecting the detection patterns 45 on the intermediate transfer belt. As the other periodic fluctuation here, there are fluctuations of various frequency components, such as a rotation period of a driving roller of the intermediate transfer belt 10, a pitch error and an eccentric component of a gear which drives and transmits the rotation period of the driving roller, meandering of the intermediate transfer belt 10, and thickness deviation distribution in a circumferential direction of the intermediate transfer belt 10. The detection data include these frequencies superimposed with each other. Among these frequencies, a fluctuation component having one rotation period of the photosensitive body drum is required to be detected at a high precision. Intervals Ps between the patterns are set equal to each other. To perform detection with a high precision, the interval Ps is required to be set short to obtain a group of dense patterns. In actuality, however, the pattern interval Ps is determined by a relationship such as an available pattern width and an operation time.

In the case where a fluctuation component of the rotation period of the driving roller 8 has a great influence on a position misalignment of the pattern in addition to a fluctuation component of one rotation period of the photosensitive body drum, for example, a sampling pattern length Pa is set by taking a rotation period of the driving roller 8 in consideration. When the photosensitive body drum 2 has a diameter of 40 mm and the driving roller 8 has a diameter of 30 mm in this embodiment, rotation periods of the photosensitive body drum 2 and the driving roller 8 are, when converted into surface moving distances of the intermediate transfer belt, 125.7 mm and 94.2 mm respectively. A common multiple of these values is set as the sampling pattern length Pa. Here, the pattern length Pa is 377 mm, which corresponds to a least common multiple. The pattern intervals Ps are set equal to each other in this pattern length Pa. Accordingly, calculating amplitude and a phase value of a fluctuation component of one rotation period of the photosensitive body drum can be detected at high precision without receiving an influence of a fluctuation component of the driving roller 8. This is because an operation factor including a fluctuation component of the driving roller 8 logically becomes just zero in calculating amplitude and a phase value, which are described below. When a rotation period fluctuation is generated due to a thickness deviation distribution in the circumferential direction of the intermediate transfer belt 10, the pattern length is set as an integral multiple of a rotation period of the photosensitive body drum, to be a closest length to a circumference of the intermediate transfer belt 10. As a result, an effect of a period fluctuation of the intermediate transfer belt 10 can be reduced.

Further, a fluctuation component which is far different from one rotation period of the photosensitive body drum, such as a fluctuation component of a motor rotation period serving as a driving source of the driving roller 8, which is ten times as large or more of one rotation period of the photosensitive body drum, can be removed by a low pass filter in a digital processing of detection data.

It is effective to mount feedback control in a driving system of the intermediate transfer belt, in enhancing a detection precision of a fluctuation component having one rotation period of the photosensitive body drum. For example, a rotary encoder is provided for a rotation axle of the support roller 12, which rotates in accordance with the surface movement of the intermediate transfer belt 10. Based on rotation data outputted by this rotary encoder, rotation of a driving motor, which is not shown, of the intermediate transfer belt 10 is controlled so that the output (rotation angular speed) of the rotary encoder becomes constant. As a result, a belt speed fluctuation caused by an error of the driving roller 8 and a driving transmitting system or slipping between the driving roller 8 and a back surface of the intermediate transfer belt 10 is greatly reduced. Therefore, the other period fluctuations are caused by a rotation period of the support roller 12. This is caused mainly because of eccentricity of the support roller 12 or an attachment eccentricity of the encoder. Thus, detection with high precision can be performed by setting the sampling pattern length Pa to be a common multiple period between a rotation period of the support roller 12 and one rotation period of the photosensitive body drum.

In the case of performing a sampling operation of the detection patterns 45 and a correcting operation according to the sampling operation, concerning the respective photosensitive body drums 2, the CPU 58 shown in FIG. 6 gives instructions to various units at a predetermined timing such as when a drum positioning sensor 20 detects the marking 4 shown in FIG. 1. Then, the CPU 58 starts to sequentially output image data of the detection patterns for the respective photosensitive body drums 2, which are set in the ROM 59, to corresponding image forming units. At this time, this operation is exactly the same as an operation of a normal image forming mode (printing mode). Accordingly, the image forming units form respective detection patterns according to the image data of the detection patterns, sequentially transfer the detection patterns onto the intermediate transfer belt 10, and form a group of patterns on the intermediate transfer belt 10. Then, a result of detecting the detection patterns by the detection sensor unit 51 is stored, as discrete data converted by the A-D converter 54, in the FIFO 55 in a predetermined sampling period set in the sampling control unit 56 as described above. The data stored in the FIFO 55 correspond to a value of an output signal of the light receiving element, which corresponds to an amount of light reflected by the pattern. This value changes depending on a toner color and a toner density of the pattern. In this embodiment, it is preferable to recognize a timing to detect the passing detection pattern with a high precision. In view of this, the passing of the pattern is detected by recognizing a peak of a value, instead of pattern detection by a threshold value set in advance. As a result, a position misalignment can be detected with a high precision, which is one of the features of this embodiment. This is because the detection of the passing patterns by recognizing the peaks of values is not easily influenced by a distortion of the detection patterns caused by a fluctuation of the surface moving speed of the photosensitive body drum. This is described in detail below.

FIGS. 7*a* to 7*d* are diagrams showing a relationship between a surface moving speed of the photosensitive body drum 2 and a toner density distribution of the detection patterns 45 transferred onto the intermediate transfer belt 10. FIG. 7*a* is a schematic diagram of a transfer part between the photosensitive body drum 2 and the intermediate transfer belt 10. At a contact surface between the photosensitive body drum 2 and the intermediate transfer belt 10, the photosensitive body drum 2 and the intermediate transfer belt 10, although contacting each other, individually move at independent speeds Vo and Vb respectively while slipping due to an effect of a toner, the belt, a lubricant or a lubricant layer of a photosensitive body surface layer. FIG. 7*b* is a graph, in which a horizontal axis corresponds to an interval (distance) between the patterns and a vertical axis corresponds to a toner density of detection patterns formed on the photosensitive body drum 2. In this embodiment, a pattern image is formed with a pattern interval PaN and a constant toner density.

Here, when the surface moving speed Vo of the photosensitive body drum 2 is faster than the surface moving speed Vb of the intermediate transfer belt 10 (Vo>Vb), detection patterns as shown in FIG. 7*c* are formed by transferring the detection patterns shown in FIG. 7*b* onto the intermediate transfer belt 10. In this case, since the surface of the photosensitive body drum 2 passes the surface of the intermediate transfer belt 10 in the transfer part, a pattern interval PaH on the intermediate transfer belt 10 becomes shorter than a pattern interval PaN on the photosensitive body drum 2. Further, a widening part of a pattern density, which is shown by Tw in the drawing, indicates a density distribution caused by a distortion of the pattern generated by a difference in the speed between the photosensitive body drum 2 and the intermediate transfer belt 10. Since the photosensitive body drum 2 and the intermediate transfer belt 10 have a nip part of about 2 mm to achieve a high toner transfer rate in the transfer part, a toner image is rubbed by the photosensitive body drum 2 and the intermediate transfer belt 10 to be transferred. As a result, cumulative toner is distorted in accordance with a speed difference. On the other hand, when the surface moving speed Vo of the photosensitive body drum 2 is slower than the surface moving speed Vb of the intermediate transfer belt 10 (Vo<Vb), detection patterns shown in FIG. 7*d* are formed by transferring the detection patterns shown in FIG. 7*b* onto the intermediate transfer belt 10. In this case, a pattern interval PaL on the intermediate transfer belt 10 is longer than the pattern interval PaN on the photosensitive body drum 2. Moreover, a widening part of the pattern density, which is shown by Tw, is generated in a similar manner to that shown in FIG. 7*c*.

In this embodiment, it is preferable that the pattern intervals PaH and PaL which fluctuate in accordance with a fluctuation of the surface moving rate of the photosensitive body drum 2 be detected with high precision. As described above, by the fluctuation of the surface moving speed of the photosensitive body drum 2, a speed difference between the photosensitive body drum 2 and the intermediate transfer belt 10 periodically changes. As a result, a widening part of a density distribution of the detection pattern also periodically changes. Here, by a method to recognize a pattern end part by setting a threshold value, problems are generated in that a part other than the end part is detected, recognition is impossible since the pattern density does not exceed the threshold value, and the like, due to an effect of the pattern distortion. In view of this, peak values of the pattern densities are used as pattern detection timings in this embodiment. Specifically, the CPU 58 recognizes peaks of pattern densities from a group of signal data of the FIFO 55, which are highly correlated to a toner density and stored in a predetermined sampling period. Then, timing data (data number) of the peak are stored in the RAM 60. Accordingly, the pattern intervals PaH and PaL can be more accurately recognized.

The detection data of the pattern intervals recognized in this manner (referred to as "pattern detection data", hereinafter) are stored in the RAM 60. The pattern detection data fluctuate in a rotation period of the photosensitive body drum 2. In this embodiment, amplitude and a phase of this fluctuation component are detected. The amplitude and the phase are detected from zero-crossings or peaks of fluctuation values, with an average value of all data being zero. However, this method is impractical because the detection data are largely influenced by a noise, generating a large error. In view of this, the amplitude and phase of the fluctuation component, which are generated in the rotation period of the photosensitive body drum 2, are calculated by data processing using quadrature detection (quadrature detection process). The quadrature detection process is a known technique of signal analysis used for a demodulating circuit in a communications field.

Figure 8:
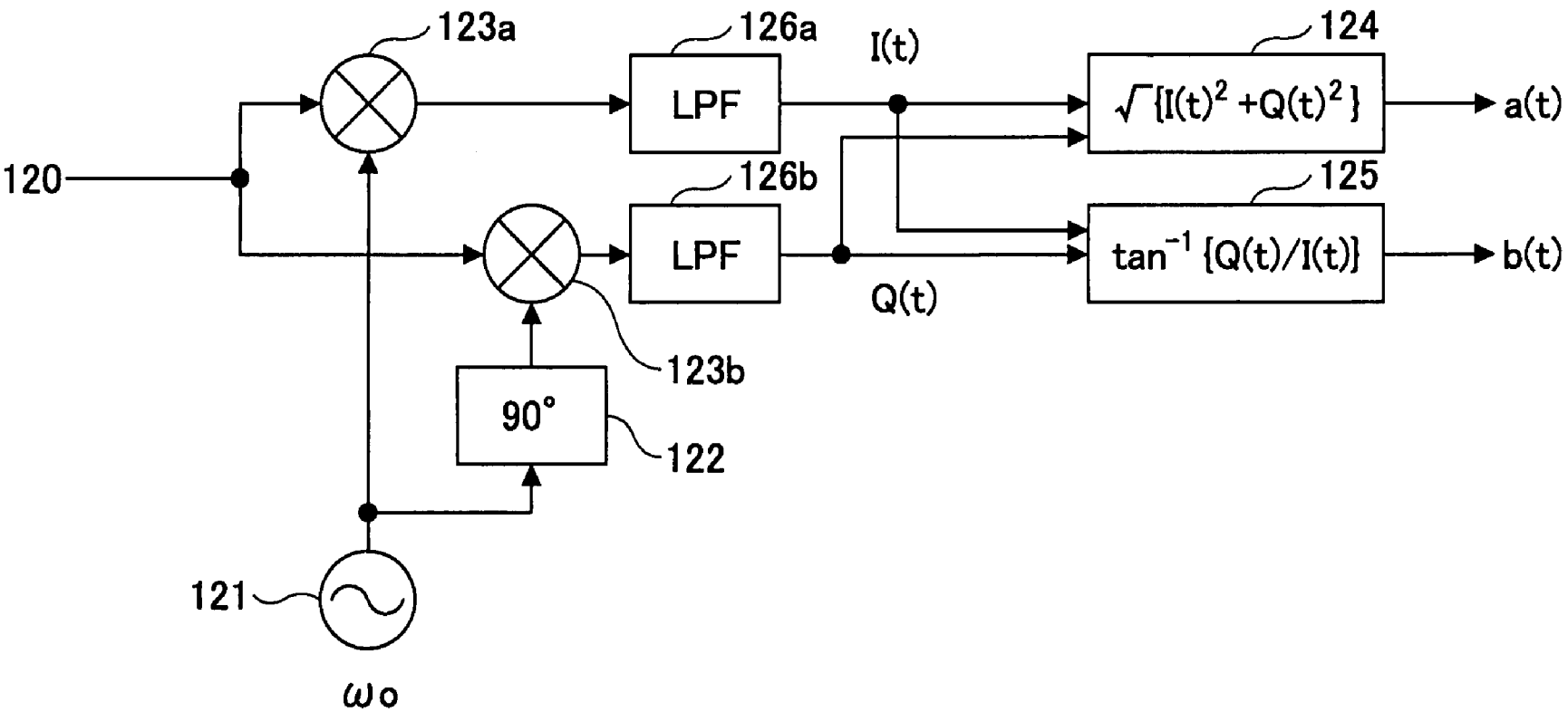
FIG. 8 is a block diagram showing a basic configuration part of a quadrature detection process.

FIG. 8 is a block diagram showing a basic configuration part of the quadrature detection process. The pattern detection data described above are based on times (tk01, tk02, tk03, . . . ) which have passed from an arbitrary reference timing until a time when the respective patterns are detected, in an order in which the patterns are formed. Therefore, the pattern detection data correspond to a monotone increasing group of data having an overlapped fluctuation component. Therefore, an increasing tendency (inclination) component is removed from the pattern detection data to obtain pattern fluctuation data. The increasing tendency (inclination) component can be obtained from the group of data by a least squares method and used as a magnification correcting value. These pattern fluctuation data are used as an input signal 120. An oscillator 121 oscillates with a frequency component to be detected, which is here a frequency ($\omega o/2\pi$) of one rotation period of the photosensitive body drum 2, and a phase based on an arbitrary reference timing used when forming the detection pattern. Then, the oscillator 121 outputs a signal to a first multiplier 123*a* and a 90° phase shifter 122. The rotation period ($2\pi/\omega o$) of the photosensitive body drum 2 can be accurately obtained by measuring an interval of detection signals of the marking 4 on the drum driving gear 32 of the photosensitive body drum 2. The first multiplier 123*a* multiplies the input signal 120 with an oscillation frequency signal outputted by the oscillator 121, while a second multiplier 123*b* multiplies the input signal 120 with a signal outputted by the 90° phase shifter 122. That is, by the multipliers 123*a* and 123*b*, the input signal 120 is separated into a signal of the same phase component (I component) and a quadrature component (Q component), signal of the photosensitive body drum. An output signal from the first multiplier 123*a* corresponds to the I component while an output signal from the second multiplier 123*b* corresponds to the Q component.

A first LPF 126*a* passes only a signal in a low frequency band among signals multiplied by the first multiplier 123*a*. A low pass filter for smoothing data corresponding to an integral multiple period of the oscillation period ($2\pi/\omega o$), which are data corresponding to the pattern length Pa here, is designed in this embodiment. The same applies to a second LPF 126*b*. In this manner, by smoothing the data corresponding to the pattern length Pa, the rotation period component of the driving roller 8, which may become a factor causing the error as described above, is cancelled out by the smoothing process to be zero. An amplitude operation unit 124 calculates amplitude a (t) corresponding to the two inputs (I component and Q component). Further, a phase operating unit 125 calculates a phase b (t) corresponding to the two inputs. The amplitude a (t) and the phase b (t) correspond to amplitude of a period fluctuation of the photosensitive body drum 2 and a phase angle of an arbitrary reference timing. In the case of detecting amplitude and a phase of a fluctuation component of a rotation period of the motor shaft gear 34, a similar process is to be performed with the oscillation period $\omega o$ set as a motor rotation period of a higher-order component.

By calculating the amplitude and phase of the fluctuation component of the pattern detection data using the quadrature detection process in this manner, the amplitude and phase of the fluctuation component can be calculated from the pattern detection data which are far less than that required in the case of detecting zero-crossings and peaks of fluctuation values. In particular, by setting the pattern intervals Ps so that detection patterns are provided in the number of 4NP (NP is a natural number) for one rotation period of the photosensitive body drum, amplitude and phase can be calculated with a high precision and less patterns. This is because the 4NP detection patterns have a positional relationship which is the most different from the fluctuation component. As a result, sensitivity of the detection becomes the highest. For example, when four patterns are provided, each pattern corresponds to a position of zero-crossing and a peak of a fluctuation. Therefore, detection sensitivity is higher than the case of another interval of the same four patterns. Even when the phases of the four patterns are shifted, this positional relationship provides high detection sensitivity.

Figure 7:
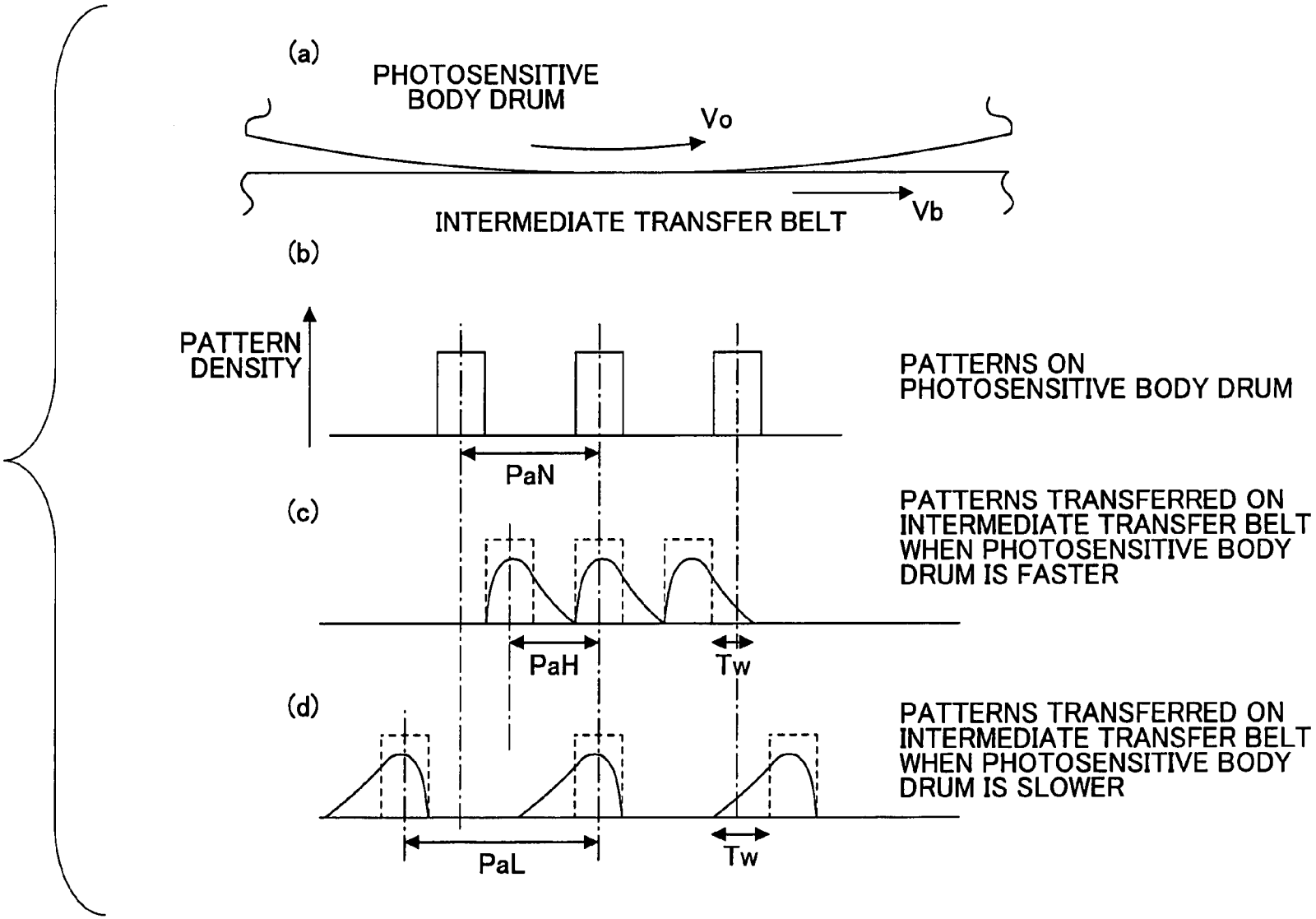
FIG. 7 is a diagram showing a relationship between a surface moving speed of a photosensitive body drum and a toner density distribution of the detection patterns 45 transferred on the intermediate transfer belt.

Based on the data of the amplitude and phase of the fluctuation component of one rotation period of the photosensitive body drum, which are detected as described above, the CPU 58 calculates a driving control correcting value (correcting pattern) of the respective photosensitive body drums 2 and sends it to the control target value output unit 38. The driving control correcting value is a value for minutely controlling rotational angular speeds of the photosensitive body drums 2 individually so as to cancel a fluctuation of the surface moving speed of the photosensitive body drum, which corresponds to the fluctuation component. That is, as shown in FIG. 7, at a timing when the pattern interval PaH shorter than the average is detected in the case where the surface moving speed of the photosensitive body drum 2 is faster, a driving speed of the photosensitive body drum 2 is corrected to be slower. At a timing when the pattern interval PaL which is longer than the average is detected in the case where the surface moving speed of the photosensitive body drum 2 is slower, the driving speed of the photosensitive body drum 2 is corrected to be faster.

Here, the data of the amplitude and phase of the fluctuation component of one rotation period of the photosensitive body drum, calculated by the pattern fluctuation data as described above, are obtained according to a fluctuation of the pattern intervals on the intermediate transfer belt 10, which is caused by two overlapped effects of a fluctuation of the surface moving speed of the photosensitive body drum in an exposure point SP of the photosensitive body drum and a fluctuation of the surface moving speed of the photosensitive body drum in a transfer point TP, which is a transfer position on the photosensitive body drum 2.

Figure 9:
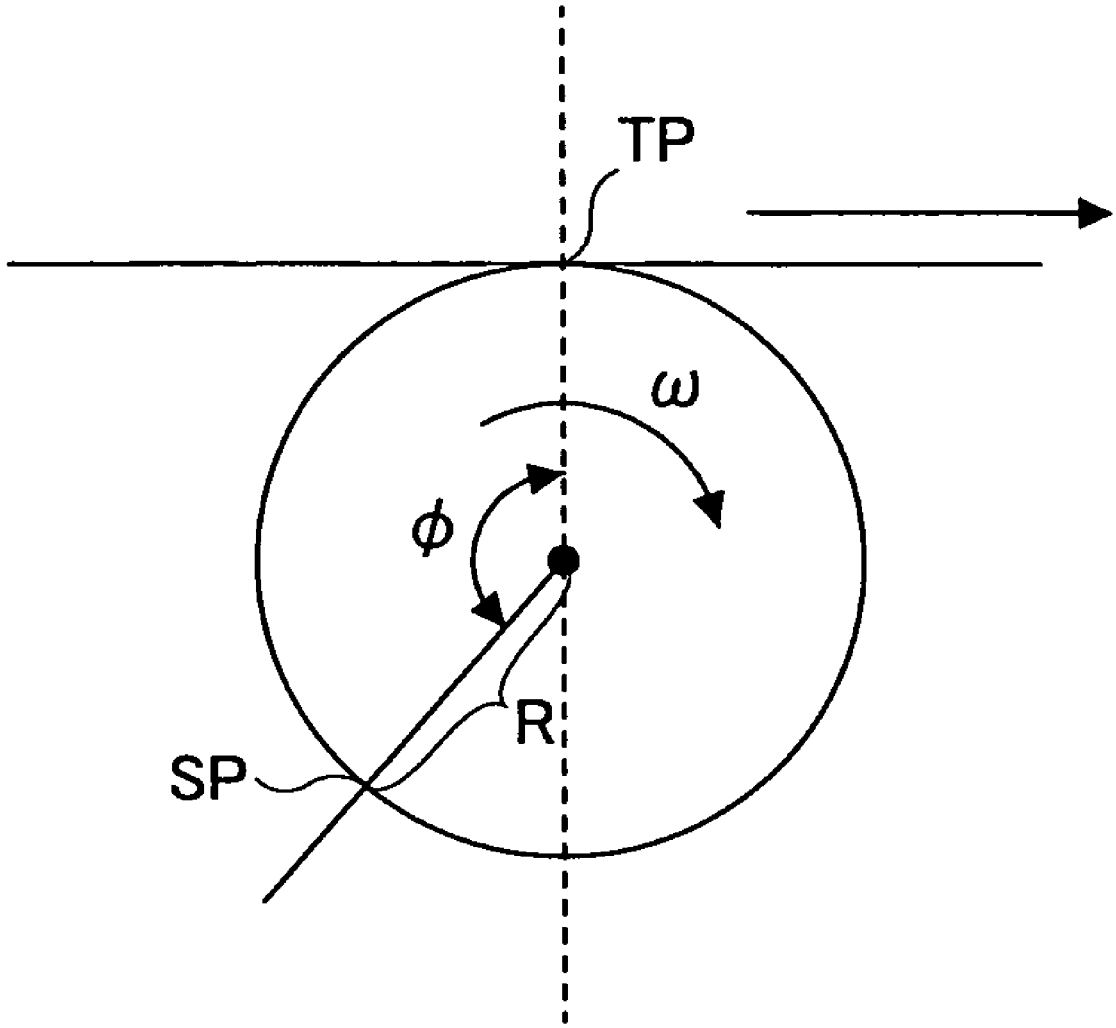
FIG. 9 is a diagram for describing a method for deriving a drive control correcting value.
Figure 10:
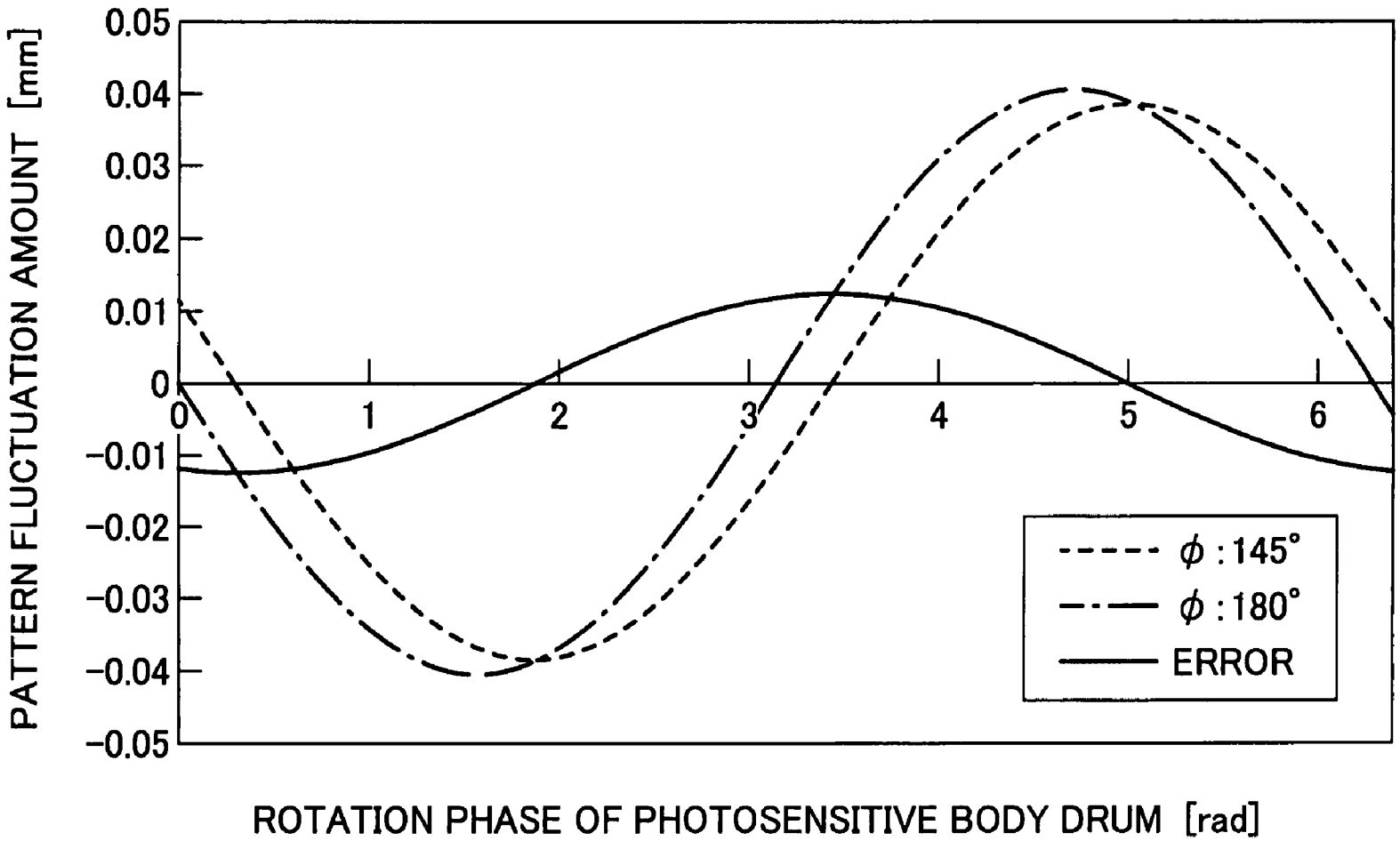
FIG. 10 is a graph showing a result of a correcting value obtained by a conventional technique disclosed in Patent Document 1.

In view of this, in a configuration as shown in FIG. 9, a phase difference angle is $\phi$ between the exposure point SP and the transfer point TP on the photosensitive body drum 2, which are set arbitrarily. In this configuration, a relationship between a rotation angular speed fluctuation of the photosensitive body drum 2, which causes a fluctuation of the surface moving speed of the photosensitive body drum having one rotation period of the photosensitive body drum, and the pattern interval on the intermediate transfer belt 10 is shown. Next, a method for obtaining an appropriate driving control correcting value (correcting pattern) from pattern fluctuation data based on the above-described pattern detection data is described.

By using the timing at which the drum position sensor 20 detects the marking 4 as a reference, a latent image of the detection patterns is written in the exposure point SP on the photosensitive body drum 2 at a constant time interval. At this time, the rotation angular speed $\omega$ of the photosensitive body drum satisfies the formula (1) below.

[Formula 1]

$$\omega=\omega_o+\Delta\omega\cos(\omega_o t_0+\alpha) \tag{1}$$

In the formula (1), a second term on the right hand side, which is $\Delta\omega\cos(\omega t_0+\alpha)$, indicates a rotation angular speed fluctuation having the same period as one rotation period of the photosensitive body drum in an arbitrary time $t_0$, by using the timing at which the drum position sensor 20 detects the marking 4 as a reference. Specifically, a rotation fluctuation caused by eccentricity and the like of the drum driving gear 32 provided for the shaft of the photosensitive body drum 2 is mainly shown. $\alpha$ indicates a phase of a period fluctuation, by using the timing at which the drum position sensor 20 detects the marking 4 as a reference. A surface moving speed $V_{SP}$ of the photosensitive body drum 2 at this time satisfies a formula (2) below when a radius of the photosensitive body drum 2 is R.

[Formula 2]

$$V_{SP}=R\{\omega_o+\Delta\omega\cos(\omega_o t_0+\alpha)\} \tag{2}$$

Further, in the exposure point SP, a micro pattern interval $\delta P_0$ between arbitrary two patterns formed in a micro time $\delta t$ of a constant interval satisfies a formula (3) below.

[Formula 3]

$$\delta P_0=V_{SP}\delta t=R\{\omega_o+\Delta\omega\cos(\omega_o t_0+\alpha)\}\delta t \tag{3}$$

These detection patterns are transferred on the intermediate transfer belt 10 after a time $T_\phi$, which is required for the photosensitive body drum 2 to rotate by the angle $\phi$, has passed. The angle $\phi$ here is formed by an imaginary line connecting between a rotation center of the photosensitive body drum and the exposure point SP and an imaginary line connecting between the rotation center of the photosensitive body drum and the transfer point TP, as shown in FIG. 9.

An angular speed $\omega_\phi$ of the photosensitive body drum, when the detection patterns are transferred onto the intermediate transfer belt 10, satisfies a formula (4) below.

[Formula 4]

$$\omega_\phi=\omega_o+\Delta\omega\cos(\omega_o t_0+\alpha+\phi) \tag{4}$$

A second term on the right hand side of the formula (4) corresponds to a fluctuation component of one rotation period of the photosensitive body drum when transferring the detection patterns. Therefore, a phase difference is $\phi$ after the time $T_\phi$ has passed after the latent image is written. A surface moving speed $V_{TR}$ of the photosensitive body drum 2 at this time satisfies a formula (5) below.

[Formula 5]

$$V_{TR}=R\{\omega_o+\Delta\omega\cos(\omega_o t_0+\alpha+\phi\} \tag{5}$$

Further, when the surface moving speed of the intermediate transfer belt 10 is the same as an average surface moving speed of the photosensitive body drum 2, and $V_b=R\omega_0$ is satisfied, the pattern intervals on the photosensitive body drum 2 become shorter when the surface moving speed of the photosensitive body drum is faster than the surface moving speed of the intermediate transfer belt 10, and become longer when the surface moving speed of the photosensitive body drum is slower than the surface moving speed of the intermediate transfer belt 10. Therefore, the micro pattern interval $\delta P$ transferred on the intermediate transfer belt 10 satisfies a formula (6) below, in which $P_n=R\omega_0\delta t$.

[Formula 6]

$$\delta P=\delta P_0\frac{V_b}{V_{TR}}=P_n\frac{\omega_0+\Delta\omega\cos(\omega_0 t_0+\alpha)}{\omega_0+\Delta\omega\cos(\omega_0 t_0+\alpha+\phi)} \tag{6}$$

Here, since $\Delta\omega$ is sufficiently smaller with respect to the average angular speed $\omega 0$, the formula (6) can be approximated to a formula (7) below.

[Formula 7]

$$\delta P=P_n\frac{1}{\omega_0}\{\omega_0+\Delta\omega\cos(\omega_0 t_0+\alpha)-\Delta\omega\cos(\omega_0 t_0+\alpha+\phi)\} \tag{7}$$

Further, the formula (7) can be transformed into a formula (8) below.

[Formula 8]

$$\delta P = P_n \frac{1}{\omega_0}\left\{\omega_0 + 2\Delta\omega\sin\left(\frac{\phi}{2}\right)\sin\left(\omega_0 t_0 + \alpha + \frac{\phi}{2}\right)\right\} \tag{8}$$

The formula (8) indicates a micro pattern interval obtained after the two patterns formed in the micro time δt of a constant interval are transferred on the intermediate transfer belt 10.

When a timing to form a latent image of the detection pattern is an actual constant time interval, the pattern is written in a constant time interval Te, which is not the micro time δt, on the exposure point SP. After the pattern is transferred, a timing that the detection pattern passes is detected by the light receiving element 42 on the intermediate transfer belt 10, to recognize a pattern detection timing on the intermediate transfer belt 10. The timing at which the drum position sensor 20 detects the marking 4 is used as a reference so far. The detection pattern written at that timing is detected by the light receiving element 42 on the intermediate transfer belt 10. As shown in FIG. 5B, when a top pattern tk01 of the detection patterns 45 is used as a reference (0), an interval Pc_N between the top pattern and an N-th pattern written in a time TeN (N is a natural number) is expressed by a formula (9) below.

[Formula 9]

$$\begin{aligned} P_{C_}N &= \int_0^{TeN} \delta P\, dt_0 \\ &= \int_0^{TeN} R\left\{\omega_0 + 2\Delta\omega\sin\left(\frac{\phi}{2}\right)\sin\left(\omega_0 t_0 + \alpha + \frac{\phi}{2}\right)\right\} dt_0 \end{aligned} \tag{9}$$

From the formula (9), a following formula (10) can be obtained.

[Formula 10]

$$\begin{aligned} P_{C_}N &= R\omega_0 TeN - 2R\frac{\Delta\omega}{\omega_0}\sin\left(\frac{\phi}{2}\right)\cos\left(\omega_0 TeN + \alpha + \frac{\phi}{2}\right) + C \\ &= R\omega_0 TeN + 2R\frac{\Delta\omega}{\omega_0}\sin\left(\frac{\phi}{2}\right)\cos\left(\omega_0 TeN + \alpha + \frac{\phi}{2} + \pi\right) + C \end{aligned} \tag{10}$$

Note that C in the formula (10) is what is expressed in a following formula (11).

[Formula 11]

$$C = 2R\frac{\Delta\omega}{\omega_0}\sin\left(\frac{\phi}{2}\right)\cos\left(\alpha + \frac{\phi}{2}\right) \tag{11}$$

In this manner, the patterns written in the constant time interval Te have a pattern interval expressed by the formula (10) on the intermediate transfer belt 10 and detected by the light receiving element. The pattern detection data (time data) stored in the RAM 60 are converted from the surface moving speed value of the intermediate transfer belt 10 into a position on the intermediate transfer belt 10. Alternatively, the pattern detection data (time data) are converted from the average rotation speed of the photosensitive body drum into the position on the photosensitive body drum. A first term on the right hand side of the formula (10) corresponds to an inclination of the pattern detection data, which is used for detecting a magnification error. From the pattern detection data, amplitude and a phase of a fluctuation component of a cosine wave, which is generated in one rotation period of the photosensitive body drum, using the top pattern as a reference, are calculated by using the quadrature detection process. This fluctuation component corresponds to a second term of the right hand side of the formula (10). Amplitude A and a phase B thereof correspond to formulas (12) and (13) respectively. C as a third term of the right hand side of the formula (10) is a steady-state deviation. This value C only biases a zero level of a period fluctuation of the second term on the right hand side of the formula (10) in a direction of the amplitude, and does not influence the amplitude and phase detected by the quadrature detection.

[Formula 12]

$$A = 2R\frac{\Delta\omega}{\omega_0}\sin\left(\frac{\phi}{2}\right) \tag{12}$$

[Formula 13]

$$B = \alpha + \frac{\phi}{2} + \pi \tag{13}$$

The formulas 12 and 13 show relationships between the amplitude A and phase B of the pattern fluctuation data of the photosensitive body drum rotation period, and the amplitude Δω and the phase α of the rotation angular speed fluctuation of the photosensitive body drum, respectively. Therefore, the amplitude Δω and the phase α of the rotation angular speed fluctuation component of the photosensitive body drum are obtained from the amplitude A and phase B obtained by the pattern fluctuation data, in order to control driving of the photosensitive body drum to cancel the rotation angular speed fluctuation component.

The fluctuation component of one rotation period of the photosensitive body drum is caused by the rotation angular speed fluctuation of the photosensitive body drum 2, which is expressed by a second term in the formula (1). Therefore, a driving control correcting value for correcting the rotation angular speed fluctuation of the photosensitive body drum 2 is set as a correcting value obtained by inverting the second term of the formula (1). As for the values of the amplitude and phase corresponding to the formulas (12) and (13), which are calculated from the pattern detection data by the quadrature detection process, the value of the amplitude is divided by $\{2\times R\times\sin(\phi/2)/\omega_0\}$ and the value of the phase is delayed by $\{\phi/2+\pi\}$. The obtained values correspond to detection values of the period fluctuation of the photosensitive body drum 2. Therefore, a rotation control correcting value for correcting a period fluctuation of the photosensitive body drum has an amplitude obtained by dividing the amplitude of the formula (12) by $\{2\times R\times\sin(\phi/2)/\omega_0\}$ and a phase obtained by delaying the phase of the formula (13) by $\{\phi/2+\pi\}$, and further delaying the phase by π, that is, as a result, a phase delayed by $\phi/2$ (subtracted by $-\phi/2$). That is, the rotation angular speed control target value used for controlling the rotation angular speed of the photosensitive body is a function $\omega_{ref}$ expressed by a formula (14).

[Formula 14]

$$\omega_{ref} = \omega_0 + \frac{A\omega_0}{2R\sin\left(\frac{\phi}{2}\right)}\cos\left(\omega_0 t_0 + B - \frac{\phi}{2}\right) \quad (14)$$

The value used for this correction can be calculated in advance from the configuration of the image forming unit. Accordingly, the rotation angular speed of the driving motor 33 is controlled so as to cancel the angular speed fluctuation generated in one rotation period of the photosensitive body drum. As a result, the photosensitive body drum 2 rotates at a constant rotation angular speed.

In the case where the controller 37 shown in FIG. 2 detects a rotation angular displacement from counts of output pulses of a position control system, that is the rotary encoder 35 to perform control, a target rotation angular displacement is required to be set in the control target value output unit 38. In this case, a line control correcting value is calculated from a rotation angle θ of the photosensitive body drum expressed by a following formula (15), which is obtained by integrating the formula (1) of the rotation angular speed o of the photosensitive body drum 2, so as to cancel the fluctuation component (second term).

[Formula 15]

$$\theta = \omega_o t_0 + \frac{\Delta\omega}{\omega_o}\sin(\omega_o t_0 + \alpha) + C_0 \quad (15)$$

Then, the rotation control correcting value for correcting the rotation angle displacement of the photosensitive body drum 2 is set to be an inverted value of the second term of the formula (15). The rotation control correcting value is set by using the amplitude A and the phase B of the fluctuation component of the cosine wave using the top pattern as a reference, which is generated in one rotation period of the photosensitive body drum and obtained by the quadrature detection process from the pattern fluctuation data. By a relationship between the amplitude A and the phase B, and the rotation angular fluctuation component (second term of the formula (15)) of the photosensitive body drum, the rotation angle of the photosensitive body is controlled by a rotation angle control target function $\theta_{ref}$ expressed by a following formula (16).

[Formula 16]

$$\theta_{ref} = \omega_0 t_0 + \frac{A}{2R\sin\left(\frac{\phi}{2}\right)}\cos\left(\omega_0 t_0 + B - \frac{\phi}{2} - \frac{\pi}{2}\right) \quad (16)$$

The formula (10) expresses an interval between the top pattern and the N-th pattern as shown in FIG. 5B. As another method to measure a pattern interval besides this, there is a method to measure an interval between adjacent two patterns. As shown by arrows Pr_1, Pr_2, and Pr_N in FIG. 5B, intervals between the adjacent patterns are measured. By using the measurement result of the adjacent pattern intervals as pattern detection data, the amount of data can be less as compared to the pattern detection data using the top pattern as a reference. Elapsed time when the pattern passes the pattern sensor 40 is recognized by counts of a reference timer. When a reference timer of 1 μsec is used, count values of 1 μsec unit correspond to time data. In the case of measuring pattern intervals by using the top pattern as a reference, the count value is increased depending on the pattern length Pa. In the case of measuring the pattern intervals between the adjacent patterns, on the other hand, the count value is relatively small and within a certain range since the count value depends on the interval between the adjacent patterns at the time of set writing. With a small count value, overflowing can be prevented in an operation process of the quadrature detection process. When a high resolution reference timer is used, an advantage of measuring the interval between the adjacent patterns is further prominent.

A rotation control correcting value of the photosensitive body drum 2, which is based on the measurement result of the interval between the adjacent patterns, is described below. When Pr_N indicating an interval between the N-th pattern and an adjacent N-1th pattern is derived from an interval Pc_N between the top pattern as a reference and the N-th pattern, Pr_N is expressed by a following formula (17).

[Formula 17]

$$\begin{aligned} P_r_N &= P_C_N - P_C_N - 1 \\ &= R\omega_0 Te + 2R\frac{\Delta\omega}{\omega_0}\sin\left(\frac{\phi}{2}\right)\left\{\cos\left(\omega_0 TeN + \alpha + \frac{\phi}{2} + \pi\right) - \right. \\ &\quad \left. \cos\left(\omega_0 Te(N-1) + \alpha + \frac{\phi}{2} + \pi\right)\right\} \end{aligned} \quad (17)$$

The formula (17) is transformed to a formula (18).

[Formula 18]

$$\begin{aligned} P_r_N = R\omega_0 Te - \\ 2R\frac{\Delta\omega}{\omega_0}\sin\left(\frac{\phi}{2}\right)2\sin\left(\frac{\omega_0 Te}{2}\right)\cos\left(\omega_0 TeN + \alpha + \frac{\phi}{2} + \frac{\pi}{2} - \frac{\omega_0 Te}{2}\right) \end{aligned} \quad (18)$$

In this manner, the interval between the adjacent patterns written in the constant time interval Te becomes a pattern interval expressed by the formula (18) on the intermediate transfer belt and detected by the light receiving element. Although the pattern interval Pc_N by using the top pattern as a reference is pattern position data, the interval between the adjacent patterns, corresponding to difference data of the pattern interval Pc_N using the top pattern as a reference, is average speed data between the adjacent patterns. The pattern detection data (time data) of the interval between the adjacent patterns, which are stored in the RAM 60, are converted from the surface moving speed of the intermediate transfer belt 10 into a position on the intermediate transfer belt 10. Alternatively, the pattern detection data are converted from an average rotation speed of the photosensitive body drum into a position on the photosensitive body drum. From the pattern fluctuation data, amplitude A' and a phase B' of a fluctuation component of a cosine wave using the top pattern as a reference, which is generated in one rotation period of the photosensitive body drum, are calculated by using the quadrature detection process. The amplitude A' and the phase B' are expressed by formulas (19) and (20) respectively.

[Formula 19]

$$A' = -2R\frac{\Delta\omega}{\omega_0}\sin\left(\frac{\phi}{2}\right)2\sin\left(\frac{\omega_0 Te}{2}\right) \tag{19}$$

[Formula 20]

$$B' = \alpha + \frac{\phi}{2} + \frac{\pi}{2} - \frac{\omega_0 Te}{2} \tag{20}$$

From the values of the amplitude A' and the phase B', a rotation angular speed control target function of the photosensitive body drum is derived. A rotation angular speed control target function $\omega_{ref}'$ of the photosensitive body drum for canceling the second term of the formula (1), which expresses the rotation angular speed fluctuation of the photosensitive body drum, is expressed by a formula (21).

[Formula 21]

$$\omega_{ref}' = \omega_0 + \frac{A'\omega_0}{-2R\sin\left(\frac{\phi}{2}\right)2\sin\left(\frac{\omega_0 Te}{2}\right)}\cos\left(\omega_0 t_0 + B' - \frac{\phi}{2} + \frac{\omega_0 Te}{2}\right) \tag{21}$$

When comparing the rotation angular speed control target function of the photosensitive body drum, which is based on the detection data obtained by measuring the pattern interval using the top pattern as a reference and expressed by the formula (14), and the control target function based on the detection data obtained by measuring the interval between the adjacent patterns, which is expressed by the formula (21), the formula (21) includes a coefficient and a term concerning a photosensitive body rotation angle $\omega_0$Te between the adjacent patterns when writing the patterns. When the interval between the adjacent patterns is measured, obtained data correspond to average speed data of the interval between the adjacent patterns. Therefore, there is an error between the obtained average speed data and an actual speed. Thus, when converting the data into the photosensitive body drum speed control function, correction is required by taking into consideration the photosensitive body rotation angle $\omega_0$Te between the adjacent patterns when writing the patterns.

In a similar manner, the rotation angle control target function of the photosensitive body drum is derived. A rotation angle control target function $\theta_{ref}'$ of the photosensitive body drum, which cancels the second term of the formula (15), is expressed by a formula (22).

[Formula 22]

$$\theta_{ref}' = \omega_0 t_0 + \frac{A'}{-2R\sin\left(\frac{\phi}{2}\right)2\sin\left(\frac{\omega_0 Te}{2}\right)}\cos\left(\omega_0 t_0 + B' - \frac{\phi}{2} - \frac{\pi}{2} + \frac{\omega_0 Te}{2}\right) \tag{22}$$

So far, a detection pattern is written by using a timing at which the drum position sensor 20 detects the marking 40 as a reference, and then, a timing at which the detection pattern passes is detected by using a position where the detection pattern transferred onto the intermediate belt 10 is detected by the light receiving element 42 as a reference. However, when the surface moving speed of the intermediate transfer belt 10 is unstable or the average surface moving speed is uncertain because of the expansion, contraction, and the like of the diameter of the driving roller due to a temperature change, an error is generated in recognition of the reference of the pattern detection. In view of this, it is preferable to form a home toner mark to be used as a reference, in addition to the group of patterns. By using the home toner mark as a reference, a timing at which the detection pattern on the intermediate transfer belt 10 passes is detected. In this case, a phase relationship between a timing to write the home toner mark and a timing at which the drum position sensor 20 detects the marking 4 is required to be recognized so as to be reflected to a phase value in drive control correction.

According to this embodiment, even when a position relationship (a phase difference rotation angle $\phi$ between the exposure point SP and the transfer point TP) between the exposure point SP and the transfer point TP on the photosensitive body drum 2 are in any relationship, a drive control correcting value (rate correcting pattern) for correcting the surface moving speed fluctuation of the photosensitive body drum 2 can be obtained at a high precision from the pattern detection data detected on the intermediate transfer belt 10.

As in the conventional technique disclosed in Patent Document 1, when setting a phase difference angle between the exposure point SP and the transfer point TP to be 180°, which is different from actual $\phi$, and calculating the drive control correcting value to perform the control, an error generated in this case can be obtained from a difference in the pattern fluctuation values obtained by using $\phi$ and 180° as substitutes in the formula (10). As a specific example, when the photosensitive body drum has a radius R of 20 mm, a rotation angular speed has a fluctuation rate ($\Delta\omega/\omega 0$) of 0.1%, and $\alpha$ is 0, a graph in which 2.53 rad (145°) and 3.14 rad (180°) are used as substitutes as the phase difference angle $\phi$ is as shown in FIG. 1. This graph shows differences (ERROR) thereof as well. In this manner, when the exposure point SP and the transfer point TP are different in the phase difference angle by 35°, it can be seen that there is a difference in the pattern fluctuation amount by at most about 12 μm, even when the rotation angular speed has a fluctuation rate of as small as 0.1%. This difference corresponds to a control correcting error when using a method of the conventional technique. According to this embodiment, control correction can be performed at a high precision without generating such an error.

So far, the surface moving speed fluctuation of the photosensitive body drum, which is caused by the rotation angular speed fluctuation component of the photosensitive body drum, having one rotation period of the photosensitive body drum, has been described. However, a drive control correcting value can be obtained in a similar manner with respect to the surface moving speed fluctuation of the photosensitive body drum, which is generated by another cause. For example, in the case of a drive transmission mechanism having a timing belt wrapped around a driving motor shaft pulley and a photosensitive body drum shaft pulley, a rotation period $\omega$tb of the timing belt and a rotation period of the timing belt, which is $\phi$tb, which is obtained by converting a phase difference angle $\phi$ between the exposure point SP and the transfer point TP, are used as substitutes to perform a similar process to that described above. In this case, a marking and a drum position sensor are required on the timing belt, however, when there is no slipping generated between the photosensitive body drum shaft pulley and the timing belt, a reference timing of the rotation of the timing belt may be set based on a detection timing of the marking provided on the drum shaft pulley.

[Second Correcting Process]

Next, a second correcting process concerning a rotation drive control of the respective photosensitive body drums 2 is described.

First, a detection mechanism for detecting a speed fluctuation having the same period as one rotation period of the photosensitive body drum shaft is described with reference to FIGS. 11 and 12.

Figure 11B:
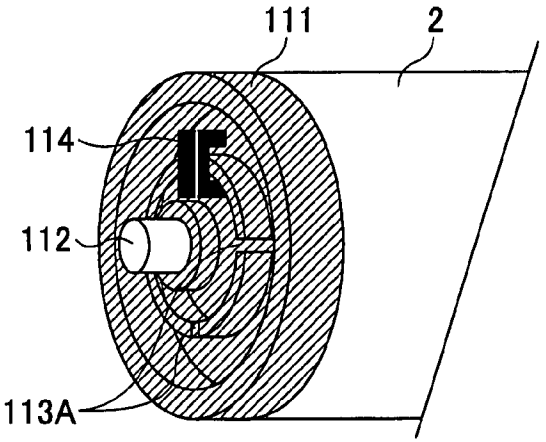
FIG. 11 is a schematic configuration diagram showing an example of providing slits in an end part of a photosensitive body drum.
Figure 11A:
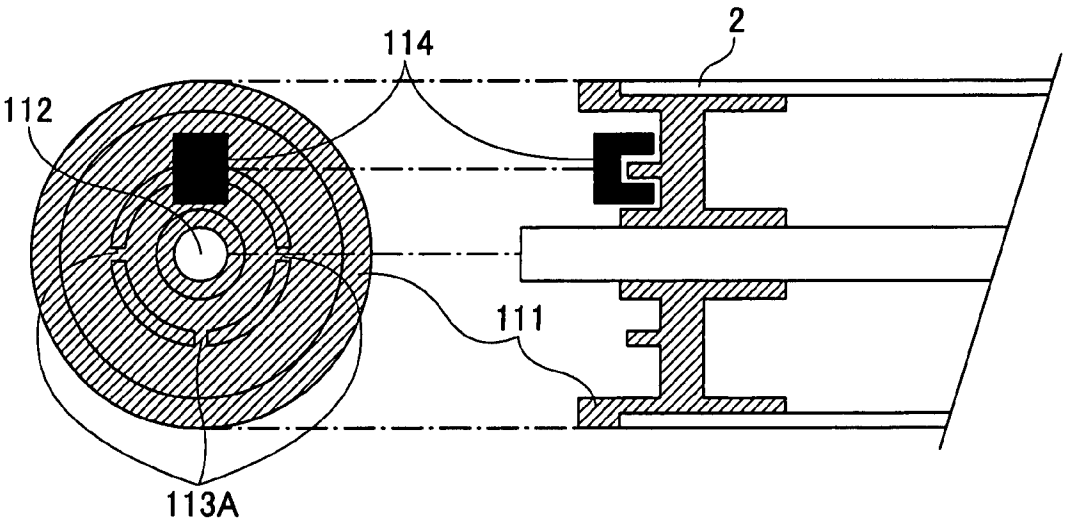
Figure 12:
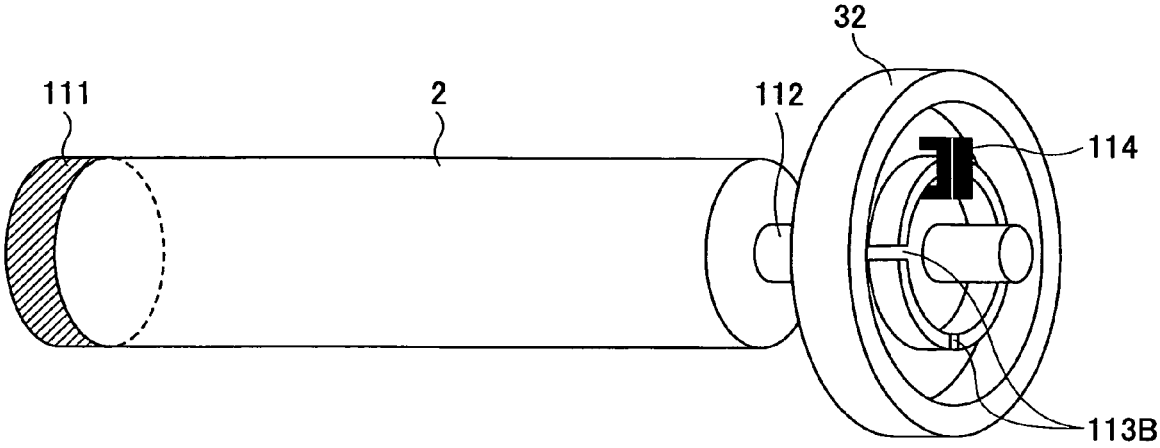
FIG. 12 is a schematic configuration diagram showing an example of providing slits in a drum driving gear.

Slit type parts to be detected, which are annularly provided having a photosensitive body drum shaft 112 as a center, and a detector 114 serving as a second detecting unit for detecting the passing by of the parts to be detected may be provided at either of opposing ends of the photosensitive body drum as shown in FIG. 11, or on the drum driving gear 32 side as shown in FIG. 12. However, when there is the coupling 31 provided (see FIG. 2) as in this embodiment, it is preferable to provide the parts to be detected and the detector 114 at either of the opposing ends of the photosensitive body drum as shown in FIG. 11 so that a rotation transmission error caused by a shaft center position error between the shaft of the drum driving gear 32 and the photosensitive body drum shaft can be suppressed by the correcting process of this embodiment. Moreover, the drum position sensor 20 shown in FIG. 1 and the detector 114 may be the same unit, and one of the parts to be detected may be used as the marking 4. When using one of the parts to be detected as the marking 4, that part may have a different slit shape or a different slit interval than the other parts, and the like.

A rotation board on which the parts to be detected are provided is fixed rotatably about the photosensitive body drum shaft 112 as a center or provided on a side surface of the photosensitive body drum 2 rotatably in an integrated manner with the photosensitive body drum 2. Alternatively, the rotation board is provided on a side surface of a gear of the drum driving gear 32. For example, when the rotation board is provided in an integrated manner with the photosensitive body drum, a slit 113A as a part to be detected is provided in a flange 111 of the photosensitive body drum 2 as shown in FIG. 11. Further, when the rotation board is provided for the drum driving gear 32, a slit 113B as a part to be detected is provided on an end face flange of the gear 32, as shown in FIG. 12.

The detector 114 detects the passing by of the slits 113A and 113B formed between slit pieces (parts between the slits), and an edge of each slit piece. The detector 114 is formed of a light emitting element and a light receiving element, and has a configuration to detect existence or absence of light blocked by the slit piece. As another configuration, a reflective type configuration may be formed by forming the slit piece using a light reflection mark and detecting light reflected by the light reflection mark by the light receiving element. Further, the part to be detected may be formed of a magnetic body and the detector may be formed of a magnetic sensor to magnetically detect the passing by of the part to be detected.

In this embodiment, the part to be detected is formed of four slits 113A and 113B having center angles shifted at 90° from each other, so as to detect one rotation period fluctuation of the photosensitive body drum with less slits and edges and at high sensitivity. Four or more of the slits 113A and 113B may be provided in one circumference of the photosensitive body.

In this embodiment, in order to detect a rotation period fluctuation of the photosensitive body drum 2 based on the detection data of the passing by of the slits 113A, 113B, and the edge (detection data of the parts to be detected), it is preferable that a transmission mechanism from the driving motor 33 to the photosensitive body drum 2 have an integer gear ratio between the motor shaft gear 34 and the drum driving gear 32 shown in FIG. 2. Consequently, calculation of values of the amplitude and phase of a fluctuation component of one rotation period of the photosensitive body drum by the quadrature detection process can be detected at a high precision without being influenced by the fluctuation component of the motor shaft gear 34.

Figure 13:
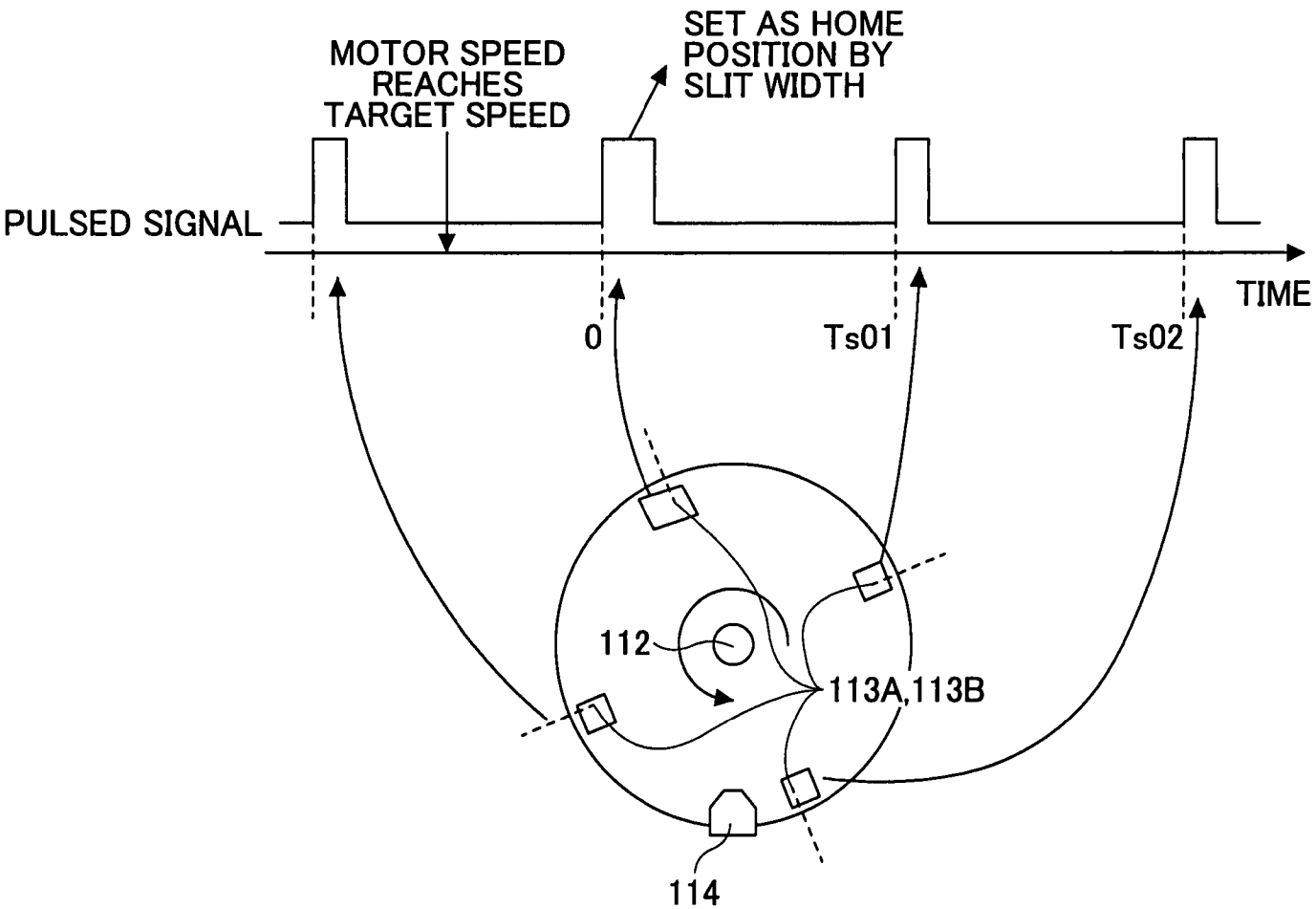
FIG. 13 is a diagram for describing a relationship between a slit provided on a photosensitive body drum and a detection result of the slit by a detector.

Below, a configuration in which the drum position sensor 20 shown in FIG. 1 and the detector 114 are the same unit and one of the slits serving as the parts to be detected is used as the marking 4 is described with reference to FIG. 13. FIG. 13 is a diagram for describing a relationship between the slits 113A and 113B provided on the photosensitive body drum and a detection result of these by the detector 114. In this embodiment, one of the four slits is formed so as to have a wider slit width than the other slits. In FIG. 13, for convenience, the slits 113A and 113B at three positions have substantial square shapes while the other slit has a slit width in a substantial rectangle shape. When the driving motor 33 rotates at a constant speed in the vicinity of the target value, an output signal (pulsed signal) from the detector 114, which indicates the passing by of one slit, has a pulse time width which is obviously wider than those of the other slits. Therefore, when a wider pulse time width with respect to a reference pulse time width, which is set in advance, is detected, it can be determined that a home position has been passed. That is, the marking 4 is detected. In this manner, by providing a sufficiently wider slit width with respect to a fluctuation of a pulse time width generated by rotation fluctuation of the photosensitive body drum 2, the home position can be detected.

Next, a step of calculating a fluctuation of one rotation period of the photosensitive body drum by using the slits 113A, 113B, and the detector 114 is described.

First, when the driving motor 33 reaches the target rotation angular speed and there is an instruction to detect a fluctuation of one rotation period of the photosensitive drum from the image forming apparatus body, output pulsed signals of the detector 114 are sampled. Electric hardware for sampling the output pulsed signals is similar to the one used for the first correcting process, specifically, the configuration shown in FIG. 6, having a part designed for the second correcting process is used. In this case, the part of the configuration may be commonly used as the one used for the first correcting process, shown in FIG. 6. In sampling of the output pulsed signals of the detector 114, slit passing detection times Ts01, Ts02, Ts03, . . . , by using the home position as a reference, are stored in the RAM 60 in a similar manner to the first correcting process. Data of plural rotations are preferably sampled to enhance the detection precision.

Based on the detection data of intervals between the passing by of the slits of the respective photosensitive body drums, which are stored in the RAM 60 (detection data of parts to be detected, which are hereinafter called "slit detection data"), amplitude and a phase of a rotation speed fluctuation component of the photosensitive body drum 2 are detected. In this embodiment, in a similar manner to the first correcting process, the amplitude and phase are detected by using the quadrature detection process shown in FIG. 8 for the second correcting process as well. Specifically, angular speeds between the slits are calculated based on the slit detection data. Subsequently, by calculating an average angular speed from the calculated angular speed data and dividing the angular speeds between the slits by the average angular speed, angular speed fluctuation data between the slits are obtained. This angular speed fluctuation data between the slits are used as input signals in the quadrature detection process shown in FIG. 8. As an output signal of the quadrature detection process, amplitude and a phase of a fluctuation of one rotation of the photosensitive body drum, using the home position as a reference, are obtained. In this embodiment, the sampling of the slit detection data and the quadrature detection process are performed twice, so that a rotation fluctuation of the photosensitive body drum, which has changed between the first and second sets of processes due to an environmental change and the like, can be recognized.

[Correcting Operation Based on First and Second Correcting Processes]

In this embodiment, by using the two correcting processes described above, not only a position displacement existing in an initial state, but image quality degradation caused by the position displacement that occurs after the initial state can also be suppressed. First, a sampling operation of the detection pattern 45 and a correcting operation (first correcting process) based of the sampling operation are set to be performed only once in the manufacturing step (or when changing a component for maintenance) of the apparatus. By these operations, a fluctuation component of a position displacement generated in one rotation period of the photosensitive body drum, which is caused by a component precision and an assembly precision of the photosensitive body drum, the driving transmission gear, and the coupling, is corrected. After this correction, however, a position or a size of the image forming unit, and further a position or a size of a component in the image forming unit may be slightly changed by an external force applied to the image forming apparatus or a temperature change inside the apparatus. Among these, the temperature change inside the apparatus and the external force cannot be avoided. For example, daily operations such as recovering from a paper jam and relocation of the image forming apparatus apply an external force to the image forming apparatus. When the temperature inside the apparatus changes or an external force is applied to the image forming apparatus, position alignment of images formed by the image forming units of respective colors is degraded. In this manner, in some cases, a position displacement is caused by a factor generated after the initial state, which makes it difficult to keep the high image quality.

In view of this, in this embodiment, a sampling operation of the slit detection data is performed once right after the first correcting process is performed, so as to perform slit detection as a reference. Then, when the power of the image forming apparatus is turned on, after a recovering operation from a paper jam, at another predetermined timing, or when the apparatus is in an image forming mode, a sampling operation of the slit detection data is performed again as required to perform slit detection as a comparison. In this manner, by comparing the two sampling results, a change over time of a fluctuation component of one rotation period of the photosensitive body drum in that period can be recognized. As a result, the change over time can be corrected.

Figure 14:
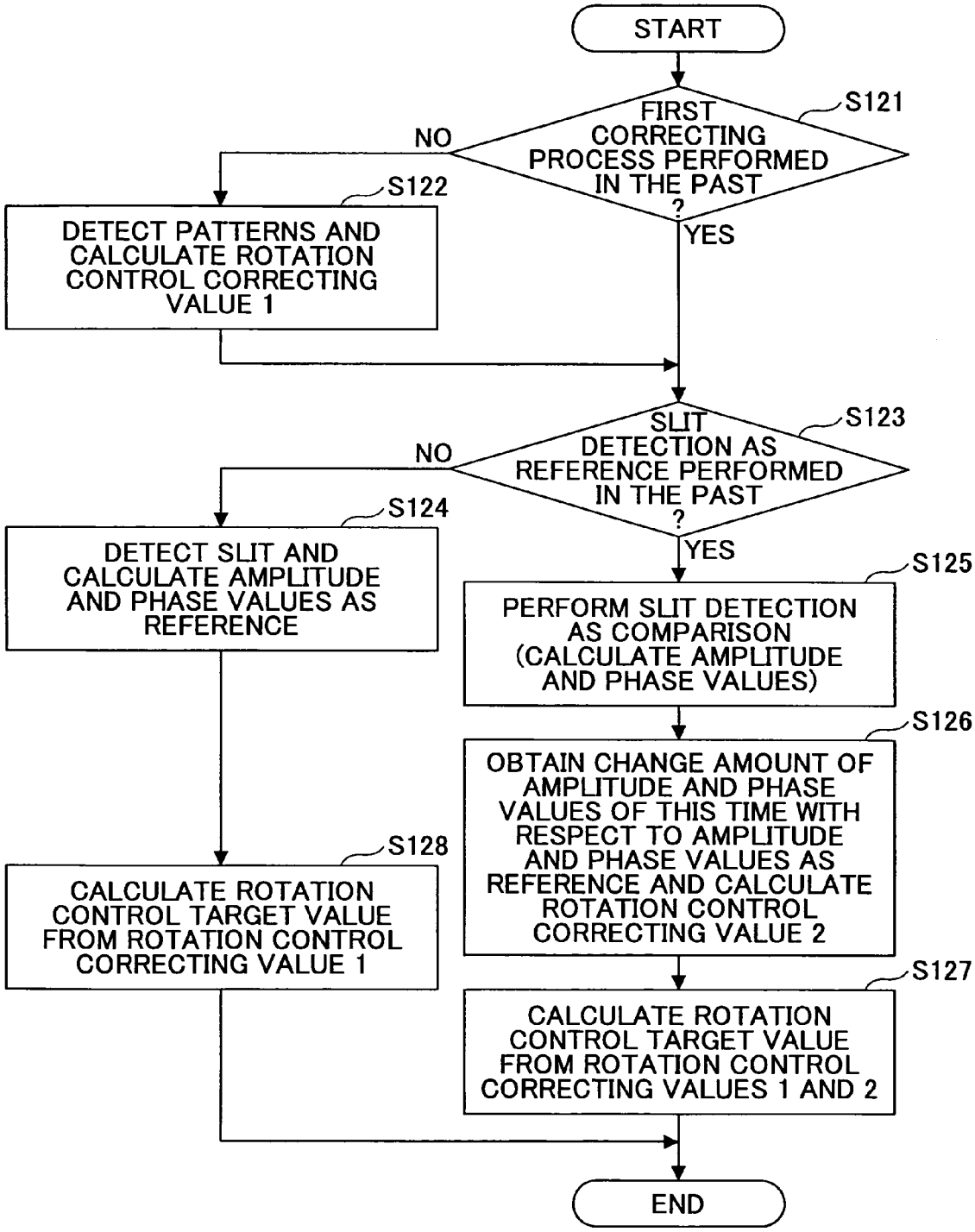
FIG. 14 is a flowchart of a correcting operation of a rotation control target value in an image forming apparatus.

FIG. 14 is a flowchart of a correcting operation of this embodiment. This correcting operation starts when the photosensitive body drum is changed, attached, or detached, when a periphery of the driving unit is repaired or changed, when the power of the image forming apparatus is turned on, after a recovering operation from a paper jam, or at another predetermined timing. First, it is determined whether the first correcting process has been performed in the past, in S121. This determination is performed by checking if the pattern detection data are stored in the RAM 60 or if the amplitude and phase data calculated from the pattern detection data are stored in the ROM 59. These data areas are set so as to delete data when the photosensitive body drum is changed, attached, or detached and the periphery of the driving unit is repaired or changed. Therefore, when the first correcting process has not been performed yet (No in S121) when the apparatus is shipped from the factory or when the photosensitive body drum is changed, a toner pattern detection and a rotation control correcting value 1 (first correcting value, that is first rate correcting pattern) are calculated (S122) The rotation control correcting value 1 calculated in S122 indicates a second term in the formula (14). The rotation control correcting value 1 is transformed to a second term of one of the formulas (14), (16), (21), and (22) depending on whether the measured pattern interval is a cumulative interval from the reference pattern or the interval between the adjacent patterns, and whether the driving motor has a control system employing an angular speed control or an angular displacement control.

Next, in S123, it is determined whether the slit detection data as a reference has been sampled in the past. This determination is performed by checking, for example, whether the first slit detection data or the amplitude and phase data based on the slit detection data are stored in the RAM 60 and ROM 59. The data area concerning the slit detection data as a reference is set so as to delete the data when the first correcting process is performed. Therefore, after the first correcting process (S122), the slit detection as a reference (first slit detection) and calculation of the amplitude and phase values (reference amplitude and phase values) of a rotation period fluctuation of the photosensitive body drum are performed (S124) unless the image forming apparatus is stopped in the slit detecting operation as a reference. Note that the pattern detection in S122 and the slit detection in S124 may be simultaneously performed. The amplitude and phase values calculated based on the slit detection data as a reference are stored in the RAM 60 as reference data.

After that, by using the rotation control correcting value 1, a rotation control target value used for controlling rotation of the photosensitive body drum is calculated (S128). Accordingly, in the image forming operation after this operation, the rotation control target value corrected by the rotation control correcting value 1 is used to control the rotation of the photosensitive body drum 2.

On the other hand, at timings when the power of the image forming apparatus is turned on or after the recovering operation from a paper jam, it is determined in S121 that the first correcting process has been performed in the past. In this case, since the slit detection as a reference has been performed as well (Yes in S123), slit detection as a comparison (second slit detection) is performed this time. Based on the obtained slit detection data, amplitude and phase values are calculated (S125). Then, change amounts of the amplitude and phase values based on the slit detection data obtained this time by the second slit detection with respect to the amplitude and phase values based on the slit detection data as a reference obtained by the first slit detection are obtained. Specifically, a difference between a trigonometric function having the amplitude and phase values as a reference, and a trigonometric function having the amplitude and phase values obtained this time is obtained. At this time, when the control target value of the driving motor 33 reflects the rotation control correcting value 1 of the first correcting value 1 in the slit detecting operations as a reference and a comparison (second slit detection), a correction by the reflected circuit control correcting value 1 is decreased. That is to say, the amplitude and phase values based on the slit detection data as a reference and a comparison (second slit detection) are returned to values obtained when the photosensitive body drum 2 is driven at the constant angular speed $\omega_0$. The difference in the trigonometric functions, which is obtained in the above process, corresponds to a change amount of a period fluctuation of the photosensitive body drum, which is caused by an environmental change and the like between the slit detection as a reference (first slit detection) and the slit detection of this time (second slit detection). In the second correcting process, a rotation control correcting value 2 (second correcting value, that is second rate correcting pattern) to cancel this change amount is calculated (S126).

By using the rotation control correcting values (rate correcting patterns) 1 and 2 obtained as described above, a rotation control target value used for controlling the rotation of the photosensitive body drum is calculated (S127). For example, when the amplitude and phase values corresponding to the difference between the two trigonometric functions, which are obtained in S126, are E and F respectively, a rotation control target value in the case of calculating the rotation control target value 1 from the formula (14) is expressed by a formula (23).

[Formula 23]

$$\omega''_{ref} = \omega_0 + \frac{A\omega_0}{2R\sin\left(\frac{\phi}{2}\right)}\cos\left(\omega_0 t_0 + B - \frac{\phi}{2}\right) - E\cos(\omega_0 t_0 + F) \tag{23}$$

A second term of the formula (23) corresponds to the rotation control correcting value (rate correcting pattern) 1 based on the amplitude A and phase B obtained in the first correcting process. A third term in the formula (23) corresponds to a rotation control correcting value (rate correcting pattern) 2 based on the amplitude E and phase F of the change amount obtained in the second correcting process.

As described above, in this embodiment, a speed fluctuation generated in one rotation period of the photosensitive body drum in the initial state is suppressed at a high precision by the rotation control correcting value (rate correcting pattern) 1. Moreover, a change of the speed fluctuation, which is generated in one rotation period of the photosensitive body drum between the slit detection as a reference (first slit detection) and the second slit detection, can be suppressed by the rotation control correcting value (rate correcting pattern) 2. Therefore, even when the speed fluctuation in one rotation period of the photosensitive body drum is changed after the initial state, the photosensitive body drum 2 can be rotated at a constant rotation angular speed without performing the first correcting process, that is, without consuming a toner.

DEFORMATION EXAMPLE 1

Next, a deformation example (this deformation example is referred to as "deformation example 1", hereinafter) of the above embodiment is described below.

Figure 15:
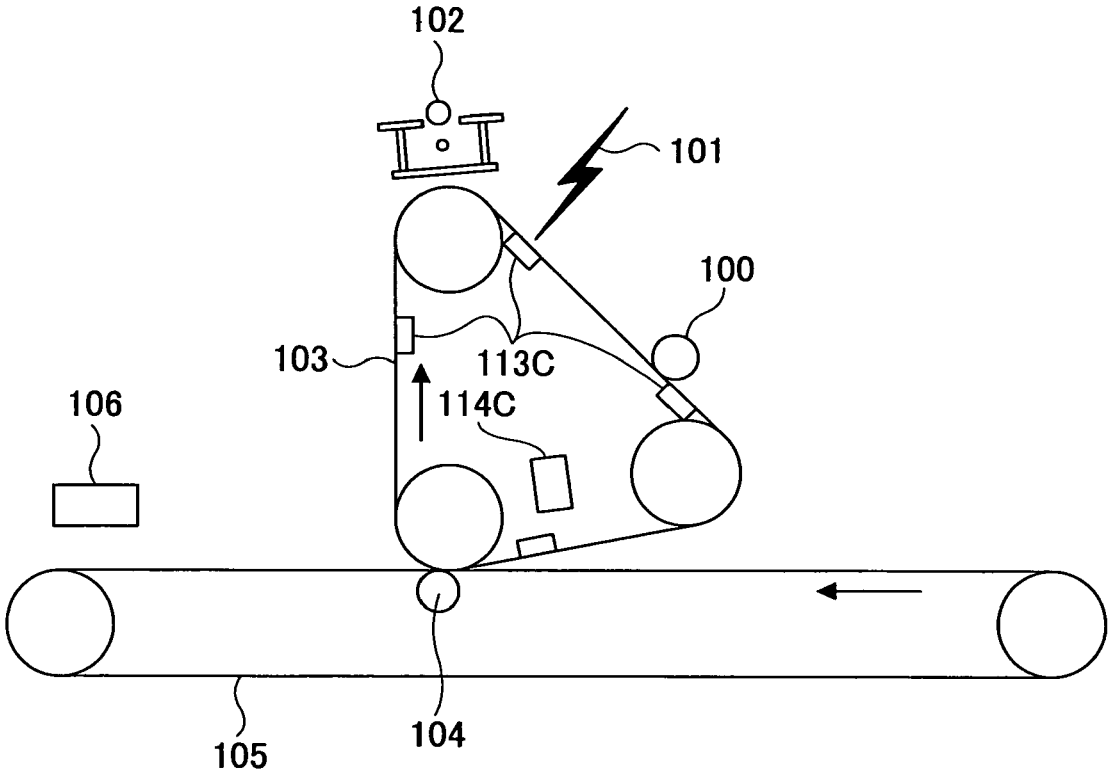
FIG. 15 is a diagram showing an image forming unit of Deformation example 1.

FIG. 15 is a diagram showing an image forming unit of this deformation example 1. In this embodiment, the case of using a photosensitive body in a drum shape as the latent image support has been described as an example. However, the present invention can be applied to a surface moving member with a latent image support having an exposure point SP and a transfer point TP. Therefore, for example, The present invention can be applied to a photosensitive body in an endless belt shape, as in this deformation example 1. A photosensitive body belt 103 in the deformation example 1 is wrapped around three support rollers. A driving roller, serving as one of the three support rollers, causes the photosensitive body belt 103 to endlessly run in the same direction as that of an intermediate transfer belt 105. Further, the photosensitive body belt 103 contacts the intermediate transfer belt 105 in a part of a lowermost roller. In a periphery of the photosensitive body belt 103, a charger 102 for charging the photosensitive body belt 103 at a predetermined potential; an exposure device, which is not shown, for exposing the charged surface with a laser light 101 in response to image signals to form an electrostatic latent image; a developer 100 for supplying a charged toner to the electrostatic latent image and developing it; and a transfer roller 104 for transferring the toner image onto the intermediate transfer belt 105, are provided sequentially. Note that the transfer roller 104 is provided inside the intermediate transfer belt 105, at a position facing the lowermost roller of the three rollers in the photosensitive body belt 103. Further, a pattern sensor 106 detects the passing by of the detection pattern formed on the intermediate transfer belt 105. In such a photosensitive body belt 103, a surface moving speed fluctuation is generated due to eccentricity of the driving roller and a thickness deviation distribution of the photosensitive body belt 103. Here, when the surface moving speed fluctuation of one rotation period of the photosensitive body belt 103 is to be corrected, a driving control correcting value can be obtained from a rotation angular speed $\omega_{ob}$ of the photosensitive body belt 103 and a phase difference rotation angle $\phi_{ob}$ between the exposure point Sp of the laser light 101 and the transfer point TP at which the intermediate transfer belt 105 contacts the photosensitive body belt 103, with respect to one rotation period of the photosensitive body belt. In addition, a parameter corresponding to a radius R and the rotation angular speed .omega. of the photosensitive body drum can be set from a circumference and the surface moving speed of the photosensitive body belt 103. Further, four parts 113C to be detected are provided at equal intervals on an inner circumference surface of the photosensitive body belt 103. A detector 114C is also provided on the inner circumference of the photosensitive body belt 103.

In this embodiment, a tandem type image forming apparatus employing an intermediate transfer method has been described as an example, however, the present invention can be applied to a tandem type image forming apparatus employing a direct transfer method in a similar manner. Further, the invention can be applied, in a similar manner, to an image forming apparatus having only one latent image support such as a photosensitive body drum. In particular, in a monochrome image forming apparatus, however, an image distortion, such as a defect due to a color shift, is not generated, however, an image distortion, in which an image is stretched or shrunk due to a position displacement caused by a periodic fluctuation of a surface moving speed of the photosensitive body drum, is generated. It is effective to apply the present invention, which can suppress such an image distortion, to a monochrome image forming apparatus.

As described above, according to an image forming apparatus of this embodiment, a latent image is formed on the surface of the photosensitive body drum 2 serving as a rotating latent image support; a toner image, formed by applying a toner onto the latent image, is transferred on the surface of the intermediate transfer belt 10 serving as a surface moving member; and the toner image on the intermediate transfer belt 10 is transferred onto a sheet as a recording member, to form an image on the sheet. The image forming apparatus of this embodiment includes the following elements: the driving control unit for controlling the drive of the photosensitive body drum 2 so that the rotation of the photosensitive body drum 2 matches a target value; the pattern sensor 40 serving as a first detecting unit which detects the plural detection patterns 45, which are obtained by developing the latent image formed on the photosensitive body drum 2 and transferring it on the surface of the intermediate transfer belt 10 and aligned along the surface moving direction of the intermediate transfer belt 10; the slits 113A and 113B serving as the plural parts to be detected, which revolve in accordance with the rotation of the photosensitive body drum 2; the detector 114 serving as the second detecting unit for detecting the slits 113A and 113B which pass by a specific point on the moving path of the plural slits 113A and 113B; the first correcting value generating unit (first correcting pattern generating unit) for obtaining an amplitude and a phase of a pattern interval fluctuation component (pattern fluctuation data) indicating the periodic surface moving speed fluctuation of the photosensitive body drum, from pattern detection data obtained by forming the plural detection patterns 45 at a predetermined timing and detecting the plural detection patterns 45 by the pattern sensor 40, and generating the rotation control correcting value 1 serving as the first correcting value (first rate correcting pattern) for canceling the surface moving speed fluctuation; the second correcting value generating unit (second correcting pattern generating unit) for performing a process to obtain an amplitude and a phase of a fluctuation component of an interval between the parts to be detected, which indicate the periodic surface moving speed fluctuation of the photosensitive body drum 2, from the slit detection data as the detection data of the parts to be detected, which are obtained by detecting the plural slits 113A and 113B by the detector 114 in a predetermined time in which the photosensitive body drum 2 rotates once or more, performing this process again, calculating a change amount of the amplitude and phase obtained by the above process (this time) with respect to the amplitude and phase obtained by the above former process (process as a reference), and generating the rotation control correcting value 2 serving as the second correcting value (second rate correcting pattern) to eliminate the change amount; and the correcting unit for correcting the target value (rate) used by the driving control unit by superimposing the rotation control correcting value 1 (first rate correcting pattern) and the rotation control correcting value 2 (second rate correcting pattern) with the target value (rate) of before the correction (target rotation angular speed). Accordingly, the speed fluctuation generated in one rotation period of the photosensitive body drum in the initial state is suppressed at a high precision by the rotation control correcting value, and in addition, a change of the speed fluctuation in one rotation period of the photosensitive body drum, which is generated between the slit detection as a reference and the slit detection of this time, can be suppressed by the rotation control correcting value 2. Therefore, even when the speed fluctuation of one rotation period of the photosensitive body drum changes after the initial state, the photosensitive body drum 2 can be rotated at a constant rotation angular speed without performing the first correcting process, that is, without consuming a toner.

Further, in this embodiment, after obtaining an amplitude and a phase of a fluctuation component of the pattern interval from the pattern detection data obtained by measuring time intervals between the top pattern and other respective patterns of the plural detection patterns, and when a rotation angular speed average value of the photosensitive body drum 2 is $\omega 0$, a rotation radius of the photosensitive body drum 2 is R, and two imaginary lines, connecting between a rotation center of the photosensitive body drum 2 and each of a position on the photosensitive body drum, at which the latent image is formed, and a position on the photosensitive body drum 2, at which the image on the photosensitive body drum 2 is transferred, on an imaginary plane surface which vertical crosses the rotation shaft of the photosensitive body drum 2, form an angle of $\phi$, the first correcting value generating unit (first correcting pattern generating unit) divides the amplitude of the fluctuation component of the pattern interval by $\{2\times R\times \sin(\phi/2)/\omega_0\}$ and delays the phase by $(\phi/2)$ to generate a value used as the rotation control correcting value 1 (rate correcting pattern). With such a configuration, even with any angle of the phase difference angle $\phi$, a proper correcting value (correcting pattern), for canceling the periodic surface moving speed fluctuation of the photosensitive body drum 2, which is caused by the rotation angular speed fluctuation of the rotational driving force transmitted to the photosensitive body drum 2, can be calculated. As a result, calculation of the proper correcting value does not limit a position relationship between the exposure point SP and the transfer point TP on the photosensitive body drum 2, thus the freedom of layout is increased.

In this embodiment, when latent images corresponding to the detection patterns 45 on the photosensitive body drum 2 are sequentially formed at a constant time interval of Te, the first correcting value generating unit (first correcting pattern generating unit) divides the amplitude of the pattern interval fluctuation component by $\{-4\times R\times \sin(\phi/2)\times \sin(\omega_0\times Te/2)/\omega_0\}$ and delays the phase of the pattern interval fluctuation component by $(\phi-\omega_0\times Te)/2$ to generate a value as the rotation control correcting value (rate correcting pattern) 1. Alternatively, the first correcting value generating unit divides the amplitude or the pattern interval fluctuation component by $\{-4\times R\times \sin(\phi/2)\times \sin(\omega_0\times Te/2)/\omega_0\}$ and delays the phase thereof by $(\phi+\pi-\omega_0\times Te)/2$ to generate a value to be used as the rotation control correcting value 1. In this case also, in a similar manner to the generation method of the rotation control correcting value 1, a proper correcting value, for canceling the periodic surface moving speed fluctuation of the photosensitive body drum 2, which is caused by the rotation angular speed fluctuation of the rotational driving force transmitted to the photosensitive body drum 2, can be calculated from the detection result of the detection patterns 45 even with any angle of the phase difference angle $\phi$. As a result, calculation of the proper correcting value does not limit a positional relationship between the exposure point SP and the transfer point TP on the photosensitive body drum 2, thus the freedom of layout is increased. Moreover, by measuring the interval between the adjacent patterns, the detection data amount can be less compared to the generating method of the rotation control correcting value 1. In particular, when a resolution of a reference timer used for measuring the pattern interval is increased, this difference in the detection data amount is prominent. In this manner, since the data amount can be reduced, overflowing in the subsequent process (such as the quadrature detection process) can be prevented.

Further, as described in the deformation example 1, when the photosensitive body belt 103, which is formed of an endless belt wrapped around the plural support rotation bodies including a driving support rotation body, is used as the photosensitive body drum 2, the first correcting value generating unit (first correcting pattern generating unit) uses a rotation angular speed average value and a rotation radius obtained by converting the photosensitive body belt 103 into a columnar shape by using the belt circumference and the average surface moving speed of the photosensitive body belt 103, with the rotation angular speed average value of $\omega_0$ and the rotation radius of R. Accordingly, the periodic surface moving speed fluctuation of the photosensitive body belt 103 can be cancelled and a position displacement can be suppressed even by using a photosensitive body belt which provides a high freedom of apparatus layout as compared to the case of using a photosensitive body drum as the photosensitive body drum 2. In the case where the photosensitive body belt 103 is used, a surface moving speed fluctuation is generated when there is a belt thickness deviation along the belt circumferential direction. However, this surface moving speed fluctuation can be recognized from a detection result of the detection pattern 45 and controlled to be corrected.

In the case of using the photosensitive body drum 2 in the columnar shape as the photosensitive body drum 2, on the other hand, the photosensitive body drum 2 in the columnar shape has a higher rigidity against a load fluctuation caused by development, transfer, cleaning, and the like performed in the periphery. Therefore, image formation can be performed at a high precision. Moreover, a rotation fluctuation of the photosensitive body drum, which is caused by a transmission error of a driving transmission system such as a gear provided on the shaft of the photosensitive body drum or a timing belt connected thereto, can be recognized by detecting the detection patterns and controlled to be corrected.

Moreover, in this embodiment, the correcting unit obtains an amplitude and a phase of the pattern fluctuation data by using the quadrature detection process. Accordingly, the amplitude and phase of the fluctuation can be obtained at a higher precision than the method of detecting zero-crossings and peaks of the fluctuation value.

In the case of calculating the rotation control correcting value (rate correcting pattern) 1 by the quadrature detection process, latent images, which are formed at equal time intervals on the surface of the photosensitive body drum 2 in a range of a natural number multiple of the circumference of the photosensitive body drum 2, are developed and transferred on the intermediate transfer belt 10. By using the obtained patterns as the detection pattern 45, the rotation control correcting value 1 having a higher precision can be obtained.

Further, in the case of calculating the rotation control correcting value 1 by the quadrature detection process, latent images, which are formed at equal time intervals on the surface of the photosensitive body drum 2 in a range of a common multiple of the circumference of the driving roller 8 serving as at least one rotation body of which rotation fluctuation contributes to the fluctuation of the pattern interval of the detection pattern 45, and the circumference of the photosensitive body drum 2, are developed and transferred onto the surface of the intermediate transfer belt 10. By using the obtained patterns as the detection pattern 45, the rotation control correcting value 1 having a higher precision can be obtained.

In the case of calculating the rotation control correcting value 1 by the quadrature detection process, latent images, which are formed at equal time intervals on the surface of the photosensitive body drum 2 so that 4NP (NP is a natural number) patterns are formed for one period of the periodic surface moving speed fluctuation of the photosensitive body drum 2, are developed and transferred onto the intermediate transfer belt 10. By using the obtained patterns as the detection patterns 45, an amplitude and a phase of the pattern fluctuation data can be obtained with the most favorable sensitivity. Accordingly, the fluctuation component can be detected efficiently with less amount of data (number of patterns).

In the case of calculating the rotation control correcting value (rate correcting pattern) 2 by the quadrature detection process, the plural slits 113A and 113B are provided at equal intervals in the circumference of the photosensitive body drum 2. Detection data obtained by detecting the slits 113A and 113B by the detector 114 in plural rotation periods of the photosensitive body drum 2 are used as the slit detection data. Consequently, the rotation control correcting value 2 having a higher precision can be obtained.

In this case, by setting the rotation period of the photosensitive body drum 2 and the rotation period of the driving source of the photosensitive body drum 2 to have an integer ratio, when operating the amplitude and phase of the fluctuation component from the slit detection data by the quadrature detection process, data to be operated become a natural number multiple period of the motor fluctuation component (noise component). Therefore, logically, there is no error in the operation result. Thus, the fluctuation component concerning the period fluctuation of the photosensitive body can be detected at a high precision.

In the case of calculating the rotation control correcting value 2 by the quadrature detection process, the amplitude and phase of the pattern fluctuation data can be obtained with the most favorable sensitivity, by forming 4NP (NP is a natural number) slits 113A and 113B for one period of the periodic surface moving speed fluctuation of the photosensitive body drum 2. Accordingly, the fluctuation component can be detected efficiently with less amount of data (number of slits).

Moreover, the pattern sensor 40 serving as a home detection unit for detecting a home toner pattern formed on the intermediate transfer belt 10 in addition to the detection pattern 45 may be provided. As the detection data thereof, data of time which has passed from when the pattern sensor 40 detects the home toner pattern until when the detection pattern 45 is detected by the pattern sensor 40 may be used. When a detection timing of a mark on the shaft of the photosensitive body drum 2 is used to obtain a phase relationship from the pattern detection data obtained from the detection result of the detection pattern 45 and the rotation angle of the photosensitive body drum 2, an error is likely to occur due to the surface moving speed fluctuation of the intermediate transfer belt. In view of this, the phase relationship is obtained by forming and detecting the home toner pattern. As a result, the phase relationship between the pattern detection data and the rotation angle of the photosensitive body drum 2 can be obtained at a high precision.

According to one embodiment, the first correcting value, that is the first rate correcting pattern, cancels out the periodic surface moving speed fluctuation of a latent image support, which is known by a detection result of the plural detection patterns formed of a toner on the latent image support in a similar manner to an actual imaging step. The correction by the first correcting value can suppress the periodic surface moving speed fluctuation of the latent image support at a high precision by using a number of detection patterns, however, there is a disadvantage in that this operation cannot be realistically performed many times since the toner is consumed. On the other hand, the second correcting value, that is the second rate correcting pattern, cancels out the periodic surface moving speed fluctuation of the latent image support, which is known by a detection result of plural parts to be detected, which revolve in accordance with the rotation of the latent image support. The correction by the second correcting value is required to have a high precision in a setting position of the plural parts to be detected. When the setting positions lack precision, the periodic surface moving speed fluctuation of the latent image support cannot be suppressed at a high precision. Therefore, cost is increased to enhance the precision of the setting position of the plural parts to be detected.

In the present invention, two correcting values, which are the first and second correcting values corresponding to the first and second rate correcting patterns, are used for correction, to compensate for disadvantages of each correction and overcome the disadvantages.

That is, according to the present invention, when there is a change caused in the periodic surface moving speed fluctuation of the latent image support by some factor after the correction by the first correcting value, the surface moving speed fluctuation after the change can be reduced by the correction using the second correcting value as described below. Accordingly, image degradation caused by the periodic surface moving speed fluctuation of the latent image support can be suppressed without frequently performing the correction by the first correcting value. Therefore, the disadvantage of the correction using the first correcting value can be solved.

Further, according to the present invention, even when there is a change in the periodic surface moving speed fluctuation of the latent image support after the correction by the first correcting value (first rate correcting pattern), the change can be suppressed at a favorable precision with the low precision of the setting position of the plural parts to be detected.

To describe this in detail, first, a process is performed to obtain, from the detection data of the parts to be detected which are obtained by detecting the plural parts to be detected by the second detecting unit, an amplitude and a phase of a fluctuation component of the interval between the parts to be detected, which indicate the periodic surface moving speed fluctuation of the latent image support. Then, the same process is performed again at a predetermined timing. Accordingly, the amplitude and phase of the process performed first and the amplitude and phase of a process performed after a certain time has passed after the first process can be obtain. Then, a change amount of the amplitude and phase of the latter process with respect to the amplitude and phase obtained in the first process is calculated. Accordingly, a change amount of the periodic surface moving speed fluctuation of the latent image support, which is generated in a period between the first process and the latter process can be known. The change amount known in this manner, being a relative value of the latter process result with respect to the first process result, does not reflect an error of a setting position of the parts to be detected. Therefore, even when the setting position precision of the parts to be detected is dissatisfactory, the change amount of the periodic surface moving speed fluctuation of the latent image support, which is generated in the period between the first process to the latter process, can be known at a high precision. As a result, by the correction using the second correcting value (second rate correcting pattern) which cancels out this change amount, the change of the periodic surface moving speed fluctuation of the latent image support, which is generated in the period between the first process and the latter process, can be suppressed at a favorable precision.

When the setting position precision of the plural parts to be detected is low, the surface moving speed fluctuation which has already been generated in the first process cannot be suppressed at a favorable precision. However, the surface moving speed fluctuation which has already been generated in the first process can be suppressed at a high precision by the correction using the first correcting value (first rate correcting pattern) in the present invention. Therefore, the disadvantage of the correction by the second correcting value (second rate correcting pattern) is solved.

According to one embodiment, there are the following superior effects. A periodic surface moving speed fluctuation of the latent image support, which is caused by the rotation angular speed fluctuation of the rotational driving force transmitted to the latent image support, is suppressed at a high precision by the correction using the first correcting value (first rate correcting pattern). Even when there is a change in the surface moving speed fluctuation caused by some factor after the suppression, the surface moving speed fluctuation after the change can be reduced by the correction using the second correcting value (second rate correcting pattern) without consuming a toner.

This patent application is based on Japanese Priority Patent Application No. 2008-068799 filed on Mar. 18, 2008, the entire contents of which are hereby incorporated herein by reference.

What is claimed is:

1. An image forming apparatus for forming an image on a recording member by forming a latent image on a surface of a rotating latent image support, applying a toner on the latent image to form a toner image, and transferring the toner image onto the recording member supported on a surface of a surface moving member, or transferring the toner image onto the surface of the surface moving member and transferring the toner image on the surface of the surface moving member onto the recording member, comprising:

a driving control unit configured to drive and control the latent image support so that the latent image support rotates at a target rate;

a first detecting unit configured to detect plural detection patterns which are formed by forming latent images on the surface of the latent image support, develop the latent images, and transfer the developed latent images onto the surface of the surface moving member, and are arranged along a surface moving direction of the surface moving member;

plural parts to be detected, which revolve in accordance with a rotation of the latent image support;

a second detecting unit configured to detect one or more of the parts to be detected passing by a specific point on a movement path of the parts to be detected;

a first correcting pattern generating unit configured to obtain a first amplitude and a first phase of a fluctuation component of an interval between the detection patterns, which indicates a periodic fluctuation of a surface moving speed of the latent image support, from pattern detection data obtained by detecting the plural detection patterns by the first detecting unit, and generate a first rate correcting pattern for canceling out the periodic fluctuation of the surface moving speed based on the first amplitude and the first phase;

a second correcting pattern generating unit configured to perform an obtaining process to obtain a second amplitude and a second phase of a fluctuation component of an interval between the parts to be detected, which indicates a periodic fluctuation of the surface moving speed of the latent image support, from parts detection data obtained by detecting the plural parts to be detected by the second detecting unit in a predetermined time in which the latent image support rotates once or more, perform the obtaining process again at a predetermined timing to obtain a third amplitude and a third phase, calculate a change amount of the third amplitude and the third phase with respect to the second amplitude and the second phase, and generate a second rate correcting pattern for canceling out the change amount; and a correcting unit configured to correct the target rate by superimposing the first rate correcting pattern and the second rate correcting pattern with the target rate.

2. The image forming apparatus as claimed in claim 1, wherein after the first correcting pattern generating unit obtains the first amplitude and the first phase of the fluctuation component of the interval between the detection patterns from pattern detection data obtained by measuring a time interval between a top detection pattern and each of other detection patterns of the plural detection patterns, said first correcting pattern generating unit generates the first rate correcting pattern by dividing the first amplitude by $\{2\times R\times\sin(\phi/2)/\omega_0\}$ and delaying the first phase by $(\phi/2)$, whereby a rotation angular speed average value of the latent image support is $\omega_0$, a rotation radius of the latent image support is R, and an angle $\phi$ is formed by imaginary lines connecting between a rotation center of the latent image support and positions on the surface of the latent image support, at which the latent image is formed and the latent image on the surface of the latent image support is transferred, on an imaginary plane surface vertically crossing a rotation shaft of the latent image support.

3. The image forming apparatus as claimed in claim 2, wherein the latent image support is formed of an endless belt wrapped around plural support rotation bodies including a driving support rotation body; and the first correcting pattern generating unit uses, as the rotation angular speed average value $\omega_0$ and the rotation radius R, a rotation angular speed average value and a rotation radius obtained when the latent image support is converted into a columnar latent image support by using a belt circumference and an average surface moving speed of the latent image support.

4. The image forming apparatus as claimed in claim 1, wherein after the first correcting pattern generating unit obtains the first amplitude and the first phase of the fluctuation component of the interval between the detection patterns from pattern detection data obtained by measuring a time interval between adjacent two detection patterns of the plural detection patterns, said first correcting pattern generating unit generates the first rate correcting pattern by dividing the first amplitude by $\{-4\times R\times\sin(\phi/2)\times\sin(\omega_0\times Te)/2)/\omega_0\}$ and delaying the first phase by $\{(\phi-\omega_0\times Te)/2\}$, or by dividing the first amplitude by $\{-4\times R\times\sin(\phi/2)\times\sin(\omega_0\times Te/2)\}$ and delaying the first phase by $\{(\phi+\pi-\omega_0\times Te)/2\}$, whereby a rotation angular speed average value of the latent image support is $\omega_0$, a rotation radius of the latent image support is R, latent images corresponding to the detection patterns are sequentially formed on the surface of the latent image support at a constant time interval of Te, and an angle $\phi$ is formed by imaginary lines connecting between a rotation center of the latent image support and positions on the surface of the latent image support, at which the latent image is formed and the latent image on the surface of the latent image support is transferred, on an imaginary plane surface vertically crossing a rotation shaft of the latent image support.

5. The image forming apparatus as claimed in claim 4, wherein the latent image support is formed of an endless belt wrapped around plural support rotation bodies including a driving support rotation body; and the first correcting pattern generating unit uses, as the rotation angular speed average value $\omega_0$ and the rotation radius R, a rotation angular speed average value and a rotation radius obtained when the latent image support is converted into a columnar latent image support by using a belt circumference and an average surface moving speed of the latent image support.

6. The image forming apparatus as claimed in claim 1, wherein the latent image support is in a columnar shape.

7. The image forming apparatus as claimed in claim 1, wherein the correcting unit employs a quadrature detection process, by which the correcting unit obtains a phase component having the same phase as a phase of the fluctuation of the surface moving speed of the latent image support and a quadrature component which is shifted from the phase of the surface moving speed fluctuation by 90° , each having a period of the fluctuation of the surface moving speed of the latent image support, from the pattern detection data or the parts detection data, to obtain the first amplitude and the first phase of the fluctuation component of the interval between the patterns or to obtain the second amplitude and the second phase of the fluctuation component of the interval between the parts to be detected, based on the phase component and the quadrature component.

8. The image forming apparatus as claimed in claim 7, wherein the correcting unit employs the quadrature detection process to obtain the first amplitude and the first phase of the fluctuation component of the interval between the patterns from the pattern detection data; and the detection patterns are formed of patterns that are obtained by forming latent images at equal time intervals on the surface of the latent image support in a range of a natural number multiple of a circumference of the latent image support, developing the latent images, and transferring the developed latent images onto the surface of the surface moving member.

9. The image forming apparatus as claimed in claim 7, wherein the correcting unit employs the quadrature detection process to obtain the first amplitude and the first phase of the fluctuation component of the interval between the patterns from the pattern detection data; and the detection patterns are formed of patterns that are obtained by forming latent images at equal time intervals on the surface of the latent image support in a range of a common multiple of a circumference of at least one rotation body of which rotation fluctuation contributes to the fluctuation of the interval between the detection patterns, and a circumference of the latent image support, developing the latent images, and transferring the developed latent images onto the surface of the surface moving member.

10. The image forming apparatus as claimed in claim 7, wherein the detection patterns are formed of patterns that are obtained by forming latent images at equal time intervals on the surface of the latent image support so that 4NP patterns, in which NP is a natural number, are formed in one period of the periodic fluctuation of the surface moving speed of the latent image support, developing the latent images, and transferring the developed latent images onto the surface of the surface moving member.

11. The image forming apparatus as claimed in claim 7, wherein the correcting unit employs the quadrature detection process to obtain the second amplitude and the second phase of the fluctuation component of the interval between the parts to be detected from the parts detection data; the plural parts to be detected are provided at equal intervals in a circumference of the latent image support; and the parts detection data are formed of detection data that are obtained by detecting the parts to be detected by the second detecting unit over plural rotation periods of the latent image support.

12. The image forming apparatus as claimed in claim 11, wherein a ratio of a rotation period of the latent image support and a rotation period of a driving source of the latent image support is an integer ratio.

13. The image forming apparatus as claimed in claim 11, wherein 4NP parts to be detected, in which 4NP is a natural number, are formed as the plural parts to be detected in one period of the periodic fluctuation of the surface moving speed of the latent image support.

14. The image forming apparatus as claimed in claim 1, further comprising a home detecting unit configured to detect a home toner pattern formed on the surface moving member in addition to the detection patterns, wherein the pattern detection data are data of time which has passed from when the home detecting unit detects the home toner pattern until when the first detecting unit detects the detection pattern.

* * * * *